US009192944B2

(12) United States Patent
Ros et al.

(10) Patent No.: US 9,192,944 B2
(45) Date of Patent: Nov. 24, 2015

(54) METHODS, SYSTEMS AND APPARATUS FOR SIZE-BASED PARTICLE SEPARATION

(71) Applicants: Alexandra Ros, Phoenix, AZ (US); Bahige G. Abdallah, Tempe, AZ (US); Tzu-Chiao Chao, Tempe, AZ (US)

(72) Inventors: Alexandra Ros, Phoenix, AZ (US); Bahige G. Abdallah, Tempe, AZ (US); Tzu-Chiao Chao, Tempe, AZ (US)

(73) Assignee: Arizona Board of Regents, A Body Corporate of the State of Arizona Acting for and on Behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 14/041,712

(22) Filed: Sep. 30, 2013

(65) Prior Publication Data

US 2014/0091012 A1 Apr. 3, 2014

Related U.S. Application Data

(60) Provisional application No. 61/707,999, filed on Sep. 30, 2012.

(51) Int. Cl.
*B03C 7/02* (2006.01)
*B03C 5/00* (2006.01)
(Continued)

(52) U.S. Cl.
CPC ..... *B03C 7/02* (2013.01); *B01L 3/502753* (2013.01); *B03C 5/005* (2013.01); *B03C 5/026* (2013.01); *B01L 2200/0652* (2013.01); *B01L 2300/0645* (2013.01); *B01L 2300/0816* (2013.01); *B01L 2300/0864* (2013.01);
(Continued)

(58) Field of Classification Search
CPC ..... B03C 5/005; B03C 5/02; B03C 5/022; B03C 5/056; B03C 7/02; B01D 57/02
USPC ..... 209/12.2, 18, 127.1, 129, 130, 155, 156
See application file for complete search history.

(56) References Cited

U.S. PATENT DOCUMENTS 6,822,180 B2 * 11/2004 Fujii et al. ..... 209/128
7,584,857 B2 * 9/2009 Bohm et al. ..... 209/155
(Continued)

FOREIGN PATENT DOCUMENTS

WO 2013/075081 5/2013

OTHER PUBLICATIONS

Spence J.C. et al., "X-ray lasers for structural and dynamic Biology", Rep Prog Phys, vol. 75, Issue 10, pp. 102601 (2012).
(Continued)

*Primary Examiner* — Patrick Cicchino
(74) *Attorney, Agent, or Firm* — McDonnell Boehnen Hulbert & Berghoff LLP

(57) ABSTRACT

A microfluidic device for size-based particle separation and methods for its use, where the microfluidic device comprises: (a) an inlet reservoir, where the inlet reservoir is configured for communication with an inlet electrode, (b) an insulator constriction coupled to the inlet reservoir via a microchannel, where the insulator constriction comprises an insulating material, and (c) a plurality of outlet channels each defining a first end and a second end, where the first end of each of the plurality of outlet channels is coupled to the insulator constriction, where the second end of each of the plurality of outlet channels is coupled to one of a plurality of outlet reservoirs, and where the plurality of outlet reservoirs are configured for communication with one or more outlet electrodes.

26 Claims, 11 Drawing Sheets

(51) Int. Cl.
*B03C 5/02* (2006.01)
*B01L 3/00* (2006.01)

(52) U.S. Cl.
CPC ... *B01L 2300/0874* (2013.01); *B01L 2400/086* (2013.01); *B03C 2201/26* (2013.01)

(56) References Cited

U.S. PATENT DOCUMENTS

| | | | | |
|---|---|---|---|---|
| 7,897,044 | B2 * | 3/2011 | Hoyos et al. | 210/198.2 |
| 8,272,576 | B2 | 9/2012 | Doak et al. | |
| 2002/0108889 | A1 * | 8/2002 | Fujii et al. | 209/39 |
| 2006/0289341 | A1 * | 12/2006 | Muller et al. | 209/210 |
| 2007/0151855 | A1 * | 7/2007 | Schnelle et al. | 204/547 |
| 2007/0163883 | A1 * | 7/2007 | Schnelle et al. | 204/547 |
| 2012/0325727 | A1 * | 12/2012 | Dionne et al. | 209/155 |
| 2013/0256197 | A1 * | 10/2013 | Katsumoto | 209/127.1 |
| 2013/0313336 | A1 | 11/2013 | Doak et al. | |
| 2014/0102948 | A1 * | 4/2014 | Jung et al. | 209/12.2 |
| 2014/0174994 | A1 * | 6/2014 | Bemate et al. | 209/155 |

OTHER PUBLICATIONS

Almen M.S. et al., "Mapping the human membrane proteome: a majority of the human membrane proteins can be classified according to function and evolutionary origin", BMC Biology, vol. 7, Issue 1, pp. 50 (2009).

Lundstrom K., "Structural genomics and drug discovery", Journal of Cellular and Molecular Medicine, vol. 11, Issue 2, pp. 224-238 (2007).

Schubert W.D. et al., "Photosystem I of Synechococcus elongatus at 4 A Resolution: Comprehensive Structure Analysis", Journal of Molecular Biology, vol. 272, Issue 5, pp. 741-769 (1997).

Fromme P. et al., "Femtosecond nanocrystallography using X-ray lasers for membrane protein structure determination", Current Opinion in Structural Biology, vol. 21, Issue 4, pp. 509-516 (2011).

Jordan P. et al., "Three-dimensional structure of cyanobacterial photosystem I at 2.5A resolution", Nature-London, vol. 411, Issue 6840, pp. 909-917 (2001).

Fromme P et al., "Improved isolation and crystallization of Photosystem I for structural analysis", Biochimica et Biophysica Acta, vol. 1365, Issue 1-2, pp. 175-184 (1998).

Hunter M.S. et al., "X-ray Diffraction from Membrane Protein Nanocrystals", Biophysical Journal, vol. 100, Issue 1, pp. 198-206 (2011).

Chapman H.N., "X-ray imaging beyond the limits", Nature Materials, vol. 8, Issue 4, pp. 299-301 (2009).

Redecke L. et al., "Natively Inhibited Trypanosoma brucei Cathepsin B Structure Determined by Using an X-ray Laser", Science, vol. 339, Issue 6116, pp. 227-230 (2013).

Chapman H. N. et al., "Femtosecond X-ray protein nanocrystallography", Nature-London, vol. 470, Issue 7332, pp. 73-77 (2011).

Boutet S. et al., "High-Resolution Protein Structure Determination by Serial Femtosecond Crystallography", Science, vol. 337, Issue 6092, pp. 362-364 (2012).

Hunter M.S. et al., "Toward structure determination using membrane-protein nanocrystals and microcrystals", Methods, vol. 55, Issue 4, pp. 387-404 (2011.

Srivastava S.K. et al., "DC insulator dielectrophoretic applications in microdevice technology: a review", Analytical and Bioanalytical Chemistry, vol. 399, Issue 1, pp. 301-321 (2011).

Majewski P. et al., "Synthesis, Surface Modifications, and Size-Sorting of Mixed Nickel—Zinc Ferrite Colloidal Magnetic Nanoparticles", Chemistry : a European journal, vol. 14, Issue 26, pp. 7961-7968 (2008).

Chen G. et al., "High-Purity Separation of Gold Nanoparticle Dimers and Trimers", Journal of the American Chemical Society, vol. 131, Issue 12, pp. 4218-4219 (2009).

Novak J. P. et al., "Purification of Molecularly Bridged Metal Nanoparticle Arrays by Centrifugation and Size Exclusion Chromatography", Analytical Chemistry, vol. 73, Issue 23, pp. 5758-5761 (2001).

Akthakul A. et al., "Size fractionation of metal nanoparticles by membrane filtration", Advanced Materials, vol. 17, Issue 5, pp. 532-535 (2005).

Gerion D. et al., "Sorting Fluorescent Nanocrystals with DNA", Journal of the American Chemical Society, vol. 124, Issue 24, pp. 7070-7074 (2002).

Yang J. et al., "Size sorting of Au and Pt nanoparticles from arbitrary particle size distributions", Analytica Chimica Acta, vol. 546, Issue 2, pp. 133-138 (2005).

Jores K. et al., "Investigations on the structure of solid lipid nanoparticles (SLN) and oil-loaded solid lipid nanoparticles by photon correlation spectroscopy, field-flow fractionation and transmission electron microscopy", Journal of Controlled Release, vol. 95, Issue 2, pp. 217-227 (2004).

Calzolai L. et al., "Separation and characterization of gold nanoparticle mixtures by flow-field-flow fractionation", Journal of Chromatography A, vol. 1218, Issue 27, pp. 4234-4239 (2011).

Pamme N. et al., "On-Chip Free-Flow Magnetophoresis: Continuous Flow Separation of Magnetic Particles and Agglomerates", Analytical Chemistry, vol. 76, Issue 24, pp. 7250-7256 (2004).

Pamme N. et al., "Continuous sorting of magnetic cells via on-chip free-flow magnetophoresis", Lab on a Chip, vol. 6, Issue 8, pp. 974-980 (2006).

Latham A.H. et al., "Capillary Magnetic Field Flow Fractionation and Analysis of Magnetic Nanoparticles", Analytical Chemistry, vol. 77, Issue 15, pp. 5055-5062 (2005).

Gascoyne P.R. et al., "Particle separation by dielectrophoresis", Electrophoresis, vol. 23, Issue 13, pp. 1973-1983 (2002).

Srivastava S.K. et al., "A continuous DC-insulator dielectrophoretic sorter of microparticles", Journal of chromatography. A, vol. 1218, Issue 13, pp. 1780-1789 (2011).

Srivastava S.K. et al., "Direct current insulator-based dielectrophoretic characterization of erythrocytes: ABO-Rh human blood typing", Electrophoresis, vol. 32, Issue 18, pp. 2530-2540 (2011).

Salomon S. et al., "A dielectrophoretic continuous flow sorter using integrated microelectrodes coupled to a channel constriction", Electrophoresis, vol. 32, Issue 12, pp. 1508-1514 (2011).

Fiedler S. et al., "Dielectrophoretic Sorting of Particles and Cells in a Microsystem", Analytical Chemistry, vol. 70, Issue 9, pp. 1909-1915 (1998).

Muller T. et al., "A 3-D microelectrode system for handling and caging single cells and particles", Biosensors & Bioelectronics, vol. 14, Issue 3, pp. 247-256 (1999).

Cheng I.F. et al., "A continuous high-throughput bioparticle sorter based on 3D traveling-wave dielectrophoresis", Lab on a chip, vol. 9, Issue 22. pp. 3193-3201 (2009).

Holmes D. et al., "On-chip high-speed sorting of micron-sized particles for high-throughput analysis", IEE proceedings. Nanobiotechnology, vol. 152, Issue 4, pp. 129-135 (2005).

Kralj J.G. et al., "Continuous Dielectrophoretic Size-Based Particle Sorting", Analytical Chemistry, vol. 78, Issue 14, pp. 5019-5025 (2006).

Pommer M.S. et al., "Dielectrophoretic separation of platelets from diluted whole blood in microfluidic channels", Electrophoresis, vol. 29, Issue 6, pp. 1213-1218 (2008).

Bligh M. et al., "Sorting microparticles into lateral streams using a two-phase rectangular electrokinetic array", Journal of Micromechanics and Microengineering, vol. 18, Issue 4, pp. 045002 (2008).

Ozuna-Chacon S. et al., "Performance characterization of an insulator-based dielectrophoretic microdevice", Electrophoresis, vol. 29, Issue 15, pp. 3115-3222 (2008).

Hellmich W. et al., "Poly(oxyethylene) Based Surface Coatings for Poly(dimethylsiloxane) Microchannels", Langmuir, vol. 21, Issue 16, pp. 7551-7557 (2005).

Cummings E.B. et al., "Dielectrophoresis in Microchips Containing Arrays of Insulating Posts: Theoretical and Experimental Results", Analytical Chemistry, vol. 75, Issue 18, pp. 4724-4731 (2003).

(56) References Cited

OTHER PUBLICATIONS

Nakano A. et al., "Tuning direct current streaming dielectrophoresis of proteins", Biomicrofluidics, vol. 6, Issue 3, pp. 34108 (2012).
Nakano A. et al., "Immunoglobulin G and bovine serum albumin streaming dielectrophoresis in a microfluidic device", Electrophoresis, vol. 32, Issue 17, pp. 2314-2322 (2011).
Martinez-Duarte R. et al., "Microfabrication technologies in dielectrophoresis applications—A review", Electrophoresis, vol. 33, Issue 21, pp. 3110-3132 (2012).
Lapizco-Encinas B.H. et al., "Insulator-based dielectrophoresis for the selective concentration and separation of live bacteria in water", Electrophoresis, vol. 25, Issue 10-11, pp. 1695-1704 (2004).
Viefhues M. et al., "Physisorbed surface coatings for poly(dimethylsiloxane) and quartz microfluidic devices", Analytical and Bioanalytical Chemistry, vol. 401, Issue 7, pp. 2113-2122 (2011).
Bhattacharya S. et al., "Insulator-based dielectrophoretic single particle and single cancer cell trapping", Electrophoresis, vol. 32, Issue 18, pp. 2550-2558 (2011).
Boekema E.J. et al., "Evidence for a trimeric organization of the photosystem I complex from the thermophilic cyanobacterium *Synechococcus* sp.", FEBS Letters, vol. 217, Issue 2, pp. 283-286 (1987).
Weierstall U. et al., "Injector for scattering measurements on fully solvated biospecies", Review of Scientific Instruments. vol. 83, Issue 3, pp. 035108 (2012).
Kissick D.J. et al., "Second-Order Nonlinear Optical Imaging of Chiral Crystals", Annual Review of Analytical Chemistry, vol. 4, pp. 419-437 (2011).
Wampler R.E. et al., "Selective Detection of Protein Crystals by Second Harmonic Microscopy", Journal of the American Chemical Society, vol. 130, Issue 43, pp. 14076-14077 (2008).
Green N.G. et al., "Dielectrophoresis of Submicrometer Latex Spheres. 1. Experimental Results", Journal of Physical Chemistry B, vol. 103, Issue 1, pp. 41-50 (1999).
Doak R.B. et al., "Microscopic linear liquid streams in vacuum: Injection of solvated biological samples into X-ray free electron lasers", AIP Conference Proceedings, vol. 1501, pp. 1314-1323 (2012).
Zhu J. et al., Dielectrophoretic focusing of particles in a microchannel constriction using DC-biased AC flectric fields, Electrophoresis, vol. 30, Issue 15 pp. 2668-2675 (2009).
Pohl H.A. et al., "Dielectrophoretic Force", J. Theor. Biol., vol. 37, pp. 1-13 (1972).
Pohl H.A. et al., "Dielectrophoresis of Cells", Biophysical Journal, vol. 11, pp. 711-727 (1971).

* cited by examiner

Figure 4A,B

METHODS, SYSTEMS AND APPARATUS FOR SIZE-BASED PARTICLE SEPARATION

RELATED APPLICATIONS

This application is a non-provisional of and claims priority to U.S. Provisional Application No. 61/707,999 for Methods, Systems and Apparatus for Size-Based Particle Separation, filed Sep. 30, 2012, which is hereby incorporated by reference in its entirety.

STATEMENT OF GOVERNMENT FUNDING

This invention was made with government support under GM095583 awarded by the National Institute of Health. The government has certain rights in the invention.

BACKGROUND OF THE INVENTION

The study of membrane proteins is important as the proteins represent 30% of cellular protein content and 70% of drug targets, and function as transporters, signal transduction mediators, and light harvesting centers, as well as electron transfer mediators in photosynthesis, among other key processes. Current techniques for membrane protein structure elucidation face obstacles due to difficulties in forming large crystals that are necessary for traditional X-ray crystallography. Smaller crystals form more easily, but they are destroyed by the high dose of radiation necessary to obtain adequate diffraction patterns and therefore cannot be used to obtain high quality structure information by traditional means. These issues are addressed by the development of femtosecond nanocrystallography in which X-ray exposure time is reduced to the femtosecond regime. Within these short time frames, nanocrystal X-ray damage is outrun so that diffraction patterns can be obtained before the crystal is destroyed.

In order to obtain high resolution diffraction patterns from crystals, a well-ordered crystal is necessary so that the diffracted signal is void of crystal lattice imperfections. Consequently, crystals in the sub-500 nm size regime are desired for improved shape transforms, crystal phasing uniformity, compatibility with beam diameters of the current state-of-the-art free electron lasers employed for nanocrystallography, and for compatibility with a jetting system used to introduce crystals to the beam. Variations in crystal size and shape lead to large amounts of single crystal diffraction data with several hundred thousand images needed for one data set. Obtaining a desired crystal size is difficult due to broad size distributions resulting from traditional crystallization, and moreover, first attempts to isolate nanocrystals such as gravitational settling procedures are time consuming and result in very low percent recoveries of desirably sized crystals.

Known nanoparticle sorting methods utilize centrifugation and filtration and result in a low abundance of protein nanocrystals, as sample loss and crystal fragmentation may occur. Other sorting methods employ conjugated or chemically functionalized nanoparticles for efficient separation yet are invasive to nanocrystallography and detrimental to downstream applications. Further, free-flow magnetophoresis methods may be suitable to separate nanoparticles continuously. However, methods based on free-flow magnetophoresis require that the nanoparticles have magnetic properties and thus cannot be applied to protein-based nanocrystals.

SUMMARY OF THE INVENTION

The present invention provides devices, methods, and systems for separating crystals and micro- and nano-particles based on size using a combination of dielectrophoresis ("DEP") and electrokinesis within a microfluidic device. Other analytes may also be sorted such as different cell types, including cancer cells, or different organelles, including mitochondria. The invention provides a significant advancement over existing sorting devices. The device includes an insulator constrictor positioned between an inlet reservoir and a plurality of outlet channels to create a heterogeneous electric field evoking dielectrophoresis as particles migrate through a microchannel defined in the insulator constrictor. DC or AC potentials are applied to the microfluidic device to induce electroosmotic flow ("EOF") as well as electric field gradients at the constriction region for dielectrophoretic focusing. This allows for sorting of broad size distributions among the target particles and/or analytes to isolate the particles and/or analytes in a high yield with a narrow size distribution and thereby improve monodispersity. Furthermore, a monodispersed sample of particles and/or analytes with a narrow size distribution may reduce the amount of data required by an order of magnitude. In addition, a monodispersed sample may be used for time-resolved studies, as diffusion times of reactants into protein crystals may be reduced.

The benefits attendant to the invention include, but are not limited to: (1) the application of the microfluidic device to particles sized from about 10 nm to about 100 μm, (2) an impact free microfluidic device minimizing the physical contact of the sample with employed electrodes, thus reducing electrode fouling and unfavorable interaction with the electrode material, (3) the ability to use a bulk solution that directly applies to crystal solutions obtained from crystallization experiments (e.g. salting-out or salting-in experiments), (4) the ability to use low electric fields (~100V/cm or less), (5) a combination to readout with several methods including, but not limited to, dynamic light scattering ("DLS"), fluorescence, Second Order Non-linear Imaging of Chiral Crystals ("SONICC") (for particle size determination and sorting, as well as crystallinity characterization), (6) the microfluidic device can be combined with a nanocrystal injector for nanocrystallography experiments (at fs X-ray sources), (7) the insulating material may be easily fabricated, (8) sorting efficiency can be tuned via control of electric potential in outlet channels, (9) the principle may be demonstrated with beads (90% exclusion of larger beads from outer channels) and crystals, (10) there is a small length for the insulator constrictor, and overall device dimensions can be adjusted per the desired application, (11) there are lab-on-a-chip advantages that include being portable, small, cheap, and robust, (12) the microfluidic devices can be used in tandem with serial or parallel coupling of the sorting insulator constrictor, (13) the electrodes can be integrated and AC tuning is possible, and (14) the device is capable of operating in a continuous mode (i.e., sample can be continually injected and processed without disruption in a consistent manner).

Thus, in a first aspect, the invention provides a microfluidic device for size-based particle separation, comprising: (a) an inlet reservoir, where the inlet reservoir is configured for communication with an inlet electrode, (b) an insulator constriction coupled to the inlet reservoir via a microchannel, where the insulator constriction comprises an insulating material, and (c) a plurality of outlet channels each defining a first end and a second end, where the first end of each of the plurality of outlet channels is coupled to the insulator constriction, where the second end of each of the plurality of outlet channels is coupled to one of a plurality of outlet reservoirs, and where the plurality of outlet reservoirs are configured for communication with one or more outlet electrodes.

In a second aspect, the invention provides a microfluidic system for size-based particle separation, comprising: (a) a first microfluidic device according to the first aspect of the invention and (b) a second microfluidic device according to the first aspect of the invention, where an outlet channel of the first microfluidic device is in communication with an inlet reservoir of the second microfluidic device.

In a third aspect, the invention provides a microfluidic system for size-based particle separation, comprising: (a) a main reservoir and (b) a plurality of microfluidic devices according to the first aspect of the invention, where the main reservoir is coupled to the inlet reservoir of each of the plurality of microfluidic devices.

In a fourth aspect, the invention provides a microfluidic system for size-based particle separation, comprising: a microfluidic device according to the first aspect of the invention in communication with a nozzle or nozzle assembly as described in U.S. Pat. No. 8,272,576, entitled Gas Dynamic Virtual Nozzle for Generation of Microscopic Droplet Streams or in U.S. patent application Ser. No. 13/680,255, entitled Apparatus and Methods for a Gas Dynamic Virtual Nozzle.

In a fifth aspect, the invention provides a method for size-based particle separation using a microfluidic device, comprising: (a) providing a bulk solution containing a plurality of particles in an inlet reservoir, where the plurality of particles comprise particles having a first size and particles having a second size, where the particles having a first size are larger than the particles having a second size, (b) generating electroosmotic flow of the plurality of particles in the bulk solution, (c) causing dielectrophoresis as the plurality of particles migrate from the inlet reservoir into a microchannel of an insulator constriction, and (d) sorting the particles having a first size and the particles having a second size.

BRIEF DESCRIPTION OF THE FIGURES

FIG. 4A is a top view of the microfluidic device for size-based particle separation (shown without outlet reservoirs), as used in the Example Section below. Specifically, a single 100 μm inlet (I) channel is connected to five outlet channels (2 outer channels (O), 2 mid-outer channels (MO), 1 center channel (C)) where sorted fractions are collected. In this embodiment, positive potential (+HV) is applied to the inlet and negative potentials (−HV) are applied to outlets. The total device length in this embodiment is 5 mm.

FIG. 4B is a detail top view of the microfluidic device's inlet reservoir, sorting region and plurality of outlet microchannels of the insulator constriction shown in FIG. 4A. In this embodiment, the inlet reservoir is 100 μm wide and converges into the insulator constrictor via a microchannel that is 30 μm wide to invoke iDEP.

FIG. 5*a*) shows −20V applied to all outlet channels and shows equal distribution for both particle sizes. FIG. 5*b*) shows −60V in central outlet channel without DEP and shows deflection of both particle sizes. FIG. 5*c*) shows −60V applied to the central outlet channel and −20V applied to the off-center outlet channels with DEP and shows that the 0.9 μm particles focus in the central outlet channel, whereas 90 nm particles deflect into the off-center outlet channels. The contrast between FIGS. 5*b*) and 5*c*) indicate the importance of DEP in the sorting mechanism. Figure d) shows that an increase in the potential applied to the central outlet to highly negative values (below −80V) can focus both particle sizes.

DETAILED DESCRIPTION OF THE INVENTION

As used herein, with respect to measurements and numerical ranges, "about" means +/−5%.

As used herein, the term "particle" is any suitable particle or analyte including, but not limited to, microparticles, nanoparticles, biological cells, biomolecules, nanocrystals, cancer cells, mitochondria or other cell organelles. The particles may range in size from about 10 nm to about 100 μm. In various embodiments, for example, nanocrystallography experiments, a crystal size <500 nm is preferred and would be the desired size-range to sort out of a bulk crystal solution using the microfluidic device. In various other embodiments, the other aforementioned particles may also have a size <500 nm to achieve the desired sorted solution characteristic. Ultimately, the desired size would be governed by the application at hand.

As used herein, the term "dielectrophoresis" ("DEP") has two different modes, positive and negative. Negative DEP refers to the repulsion from an electric field gradient region, whereas positive DEP refers to the attraction to an electric field gradient region. Positive or negative DEP behavior depends on the particle or crystal properties in relation to that of the medium.

As used herein, the term "electroosmotic flow" ("EOF") is the motion of liquid induced by an applied electric potential across a microchannel or any other fluid conduit.

Figure 1:
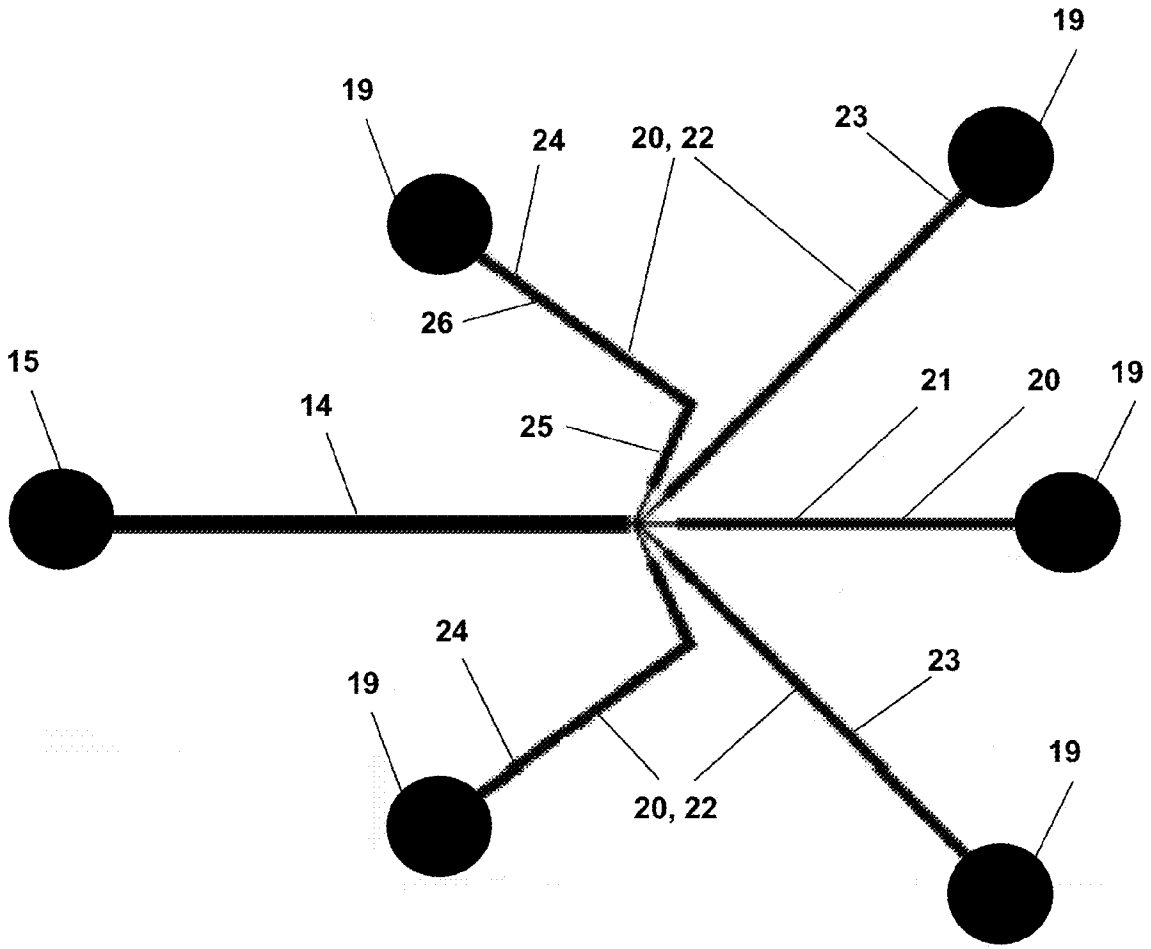
FIG. 1 is a top view of the microfluidic device for size-based particle separation.
Figure 2:
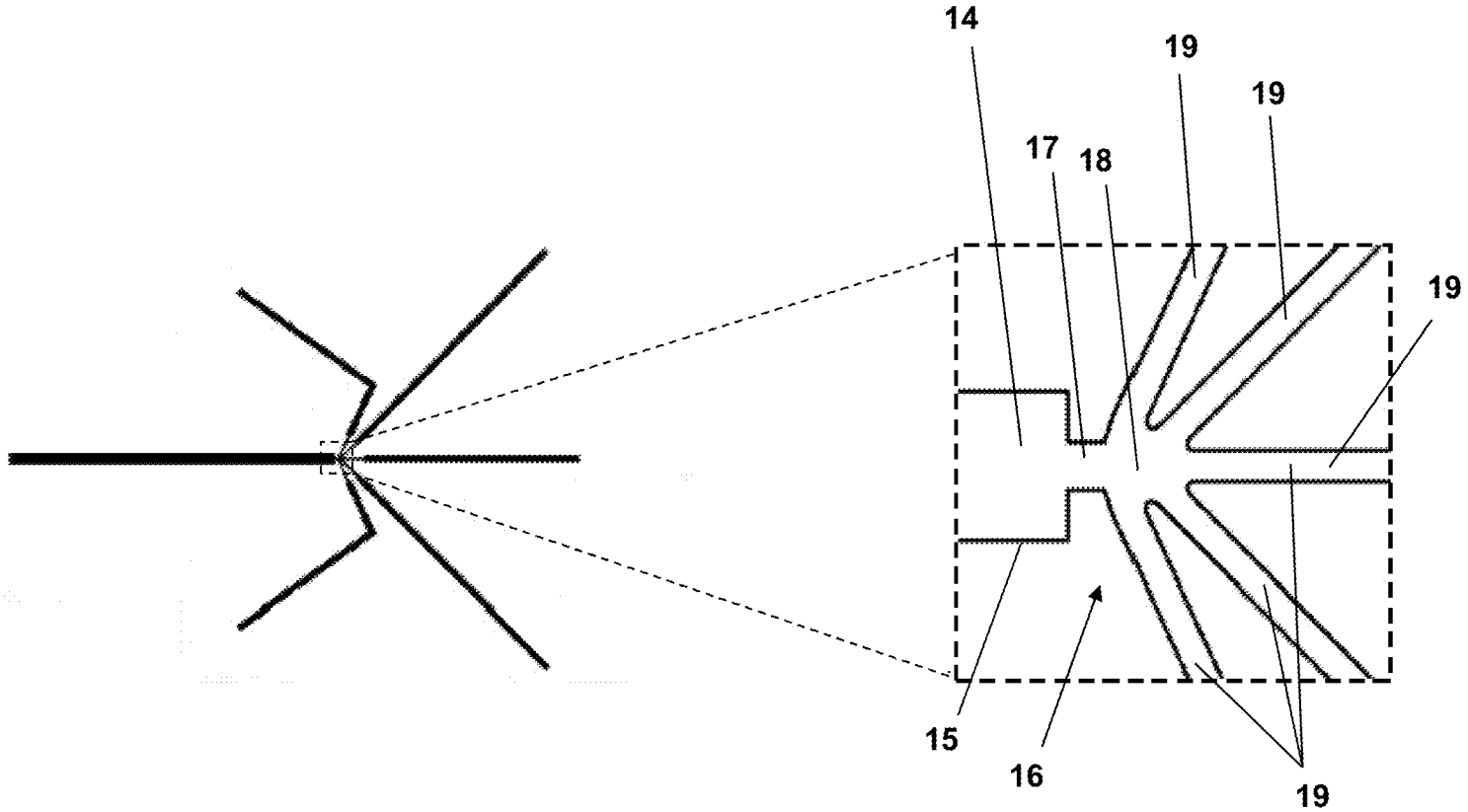
FIG. 2 is a detail top view of the microfluidic device's inlet reservoir, sorting region and plurality of outlet channels shown in FIG. 1.

In a first aspect, as shown in FIGS. 1 and 2, the invention provides a microfluidic device 10 for size-based particle separation. The device 10 may have a wide range in length from about 5 mm to about 10 cm and is preferably about 5-50 mm long.

The microfluidic device 10 includes an inlet reservoir 15 that connects to a wide inlet channel 14 that ranges in width from about 50 μm to about 1 mm and is preferably about 100-500 μm wide. The inlet channel 14 ranges in depth from about 10 μm to about 100 μm and is preferably about 40 μm deep. The inlet reservoir 15 is configured to receive via injection, for example, a bulk solution containing particles. The inlet reservoir 15 is further configured for communication with an inlet electrode (not shown). In operation, the independently controlled inlet electrode may be placed in the inlet reservoir 15 and in contact with the bulk solution to facilitate generation of an inhomogenous electric field at the insulator constriction 16. The microfluidic device may be fabricated using poly(dimethylsiloxane) and standard soft lithography, elastomer molding procedures, or any other microfabrication technique known in the art.

The microfluidic device 10 further includes an insulator constriction 16 coupled to the inlet reservoir 15 via a microchannel 17. The microchannel 17 has a width that is much smaller than the inlet reservoir and is in the range of 1 to 10 times smaller than the inlet reservoir 15. For example, in various embodiments, the microchannel 17 ranges from about 5 μm to about 300 μm in width and preferably has a width in the range from about 20 μm to about 100 μm. In other embodiments, a cross-section of the microchannel 17 may vary in width along the height of the cross-section. For example, the bottom of the cross-section may be wider than the top. The versatility of these dimensions allows the microfluidic device to be tailored to a variety of samples, to allow for variable flow rates, sample volumes, and overall throughput. In addition, varying the cross-section provides the microfluidic device with 3D selectivity capabilities in which variable electric field gradients form vertically (i.e., in the z-direction), such that the DEP force varies and influences particles differentially along the z-direction in tandem with the already in-place DEP effect in the x and y directions.

In one embodiment, shown in FIG. 2, the insulator constriction 16 further defines a sorting region 18 between the microchannel 17 and the plurality of outlet channels 20, discussed below. In one example embodiment, a diameter of the sorting region may be larger than a width of the microchannel and the diameter of the sorting region is smaller than the width of the inlet reservoir. For example, the width of the sorting region ranges from about 5 μm to about 300 μm and preferably has a width in the range from about 20 μm to about 100 μm. The insulator constriction 16 further has a geometry configured to generate electric field gradients upon application of an external electric field generated via the inlet electrode and/or the one or more outlet electrodes. This geometry includes a plurality of outlet microchannels 19 that couple the plurality of outlet channels 20 to the sorting region 18 of the insulator constriction 16. The width of the plurality of outlet microchannels ranges from about 10 μm to about 1 mm in width and preferably has a width in the range from about 50 μm to about 300 μm. The insulator constriction 16 further comprises an insulating material, for example, polydimethylsiloxane ("PDMS") or other such microfluidic materials and polymers such as glass, PMMA, polystyrene, polycarbonate, etc.

The microfluidic device 10 also includes a plurality of outlet channels 20 each defining a first end and a second end such that the first end of each of the plurality of outlet channels 20 is coupled to the insulator constriction 16 and the second end of each of the plurality of outlet channels 20 is coupled to one of a plurality of outlet reservoirs 19. In one embodiment, the plurality of outlet channels may include a central outlet channel 21. The central outlet channel 21 is preferably substantially axially aligned with the inlet reservoir 15. In a further embodiment, the plurality of outlet channels 20 includes a plurality of off-center outlet channels 22, and the plurality of off-center outlet channels 22 are not axially aligned with the inlet reservoir 15. The central axis for each of the plurality of off-center outlet channels 22 is angled in a range from about 5 degrees to about 80 degrees from a central axis of the central outlet channel 21.

In another embodiment, the plurality of off-center outlet channels 22 may comprise two middle outlet channels 23 disposed on opposing sides of the insulator constriction 16 and each arranged at an angle to the central outlet channel 22. In various embodiments, the two middle outlet channels 23 are substantially linear along their length. In alternative embodiments, each of the two middle outlet channels may be non-linear, as described below with respect to the outer outlet channels 24.

In still another embodiment, the plurality of off-center outlet channels 22 may also comprise two outer outlet channels 24. The two outer outlet channels 24 are disposed on opposing sides of the insulator constriction 16, and the two middle outlet channels 23 are arranged between the two outer outlet channels 24 and the central outlet channel 21. In various embodiments, each of the two outer outlet channels 24 is non-linear. For example, in one embodiment, each of the two outer outlet channels 24 has a first portion 25 and a second portion 26 such that the second portion 26 of each of the two outer outlet channels 24 are arranged at an angle to the first portion 25 of each of the two outer outlet channels 24 in a direction away from the central outlet channel 21 in a range from 0 degrees to 180 degrees. In another example, the two outer outlet channels 24 each comprise a substantially linear section coupled to the insulator constriction 16 at one end and that curves in a direction away from the central outlet channel 21 at the other end.

In another embodiment, the number of off-center outlet channels 22 may be further increased to allow for more particle sizes to be sorted. These additional outlet channels may also be of various sizes to achieve disparate particle size sorting. Further, the central outlet channel 21 may have a first set of dimensions, the middle outlet channels 23 may have a second set of dimensions, and the outer outlet channels 24 may have a third set of dimensions to accommodate sorting of three different particle sizes.

Figure 10A:
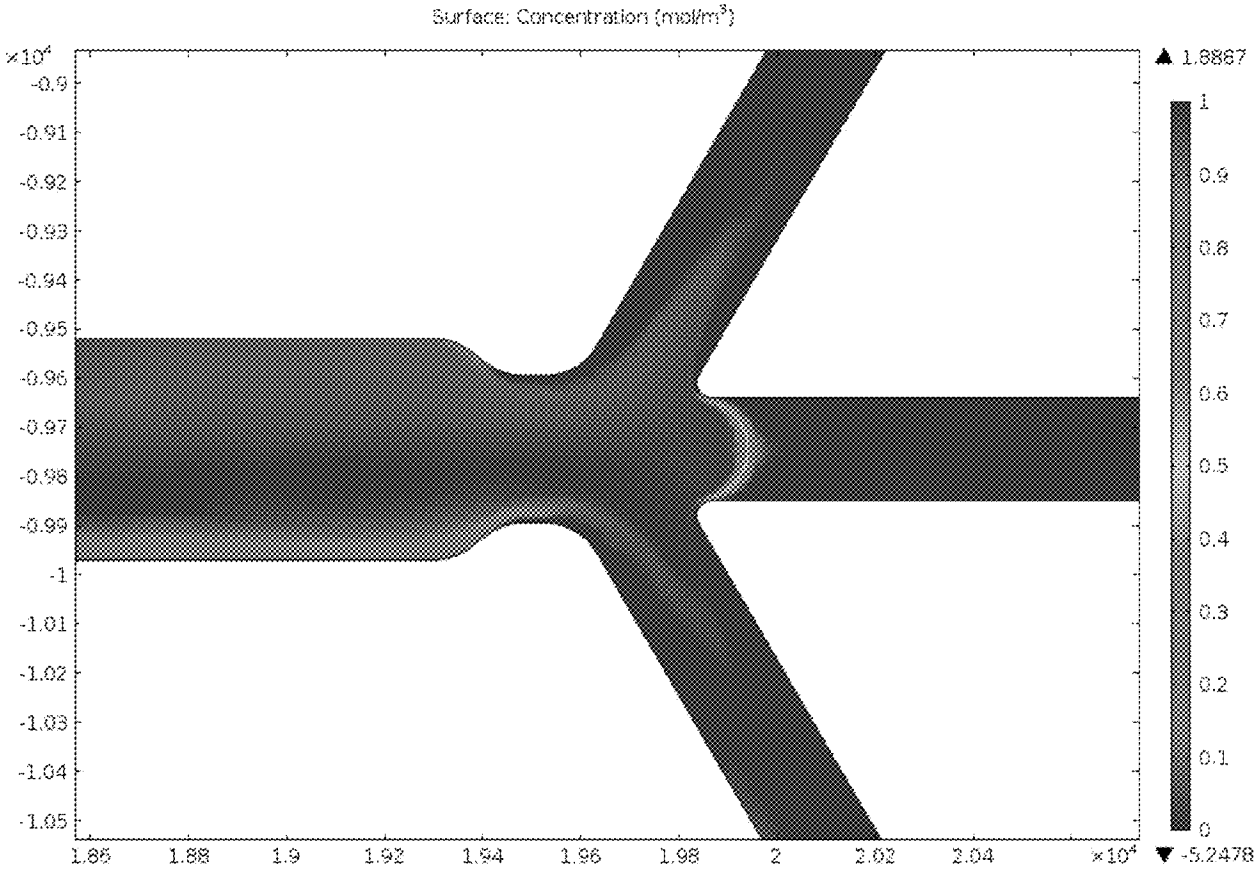
FIG. 10A shows concentration distributions as obtained from a numerical simulation showing MCF-7 cancer cells deflected into the off-center outlet channels with the application of positive DEP.

In further embodiments, the plurality of off-center outlet channels may comprise linear and/or non-linear outlet channels that may be utilized alone or in combination. For example, as shown in FIGS. 10A, B, discussed in detail below, only two off-center outlet channels may be employed. In various embodiments, the inlet reservoir 15 and the plurality of outlet channels 20 may all lie in the same plane. In alternative embodiments, the plurality of outlet channels 20 may have a three dimensional arrangement relative to one another.

The plurality of outlet reservoirs 19 are configured for communication with one or more outlet electrodes (not shown). In one example embodiment, the insulator constrictor 16, the plurality of outlet channels 20 and the plurality of outlet reservoirs are pre-loaded with a solution. The plurality of outlet reservoirs 19 each define an opening into which an outlet electrode is placed such that the electrodes are in contact with the pre-loaded solution. When the electrodes are activated to induce DEP, the pre-loaded solution conducts the current, and a potential difference between the plurality of outlet reservoirs 19 and the inlet reservoir 15 is established. This induces a bulk flow of a sample containing particles through the microfluidic device according to electroosmosis. At the insulator constrictor electric fields move particles into the insulator constriction 16 and electric field gradients then direct the particles into the outlet channels 20. The one or more outlet electrodes may comprise a single outlet electrode in communication with the central outlet channel 21. Alternatively, the one or more outlet electrodes may comprise five outlet electrodes each in communication with one of the plurality of outlet reservoirs 19.

In another embodiment, the microfluidic device 10 may include a second insulator constriction coupled either to the inlet reservoir 15 or to one of the plurality of outlet channels 20. By coupling a second insulator to the inlet reservoir 15, a greater amount of the bulk solution containing particles may be sorted in a shorter amount of time. By coupling a second insulator to one of the outlet channels, particles may be further sorted to a narrower particle size range.

Figure 3:
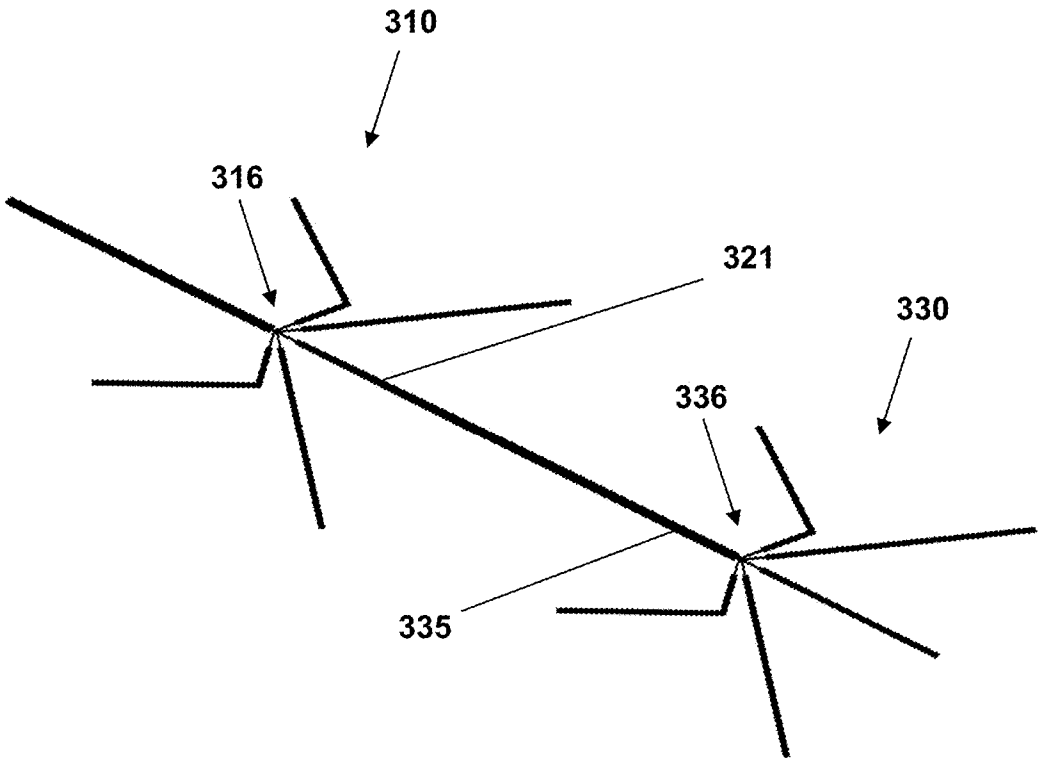
FIG. 3 is an isometric view of a first microfluidic device in communication with a second microfluidic device.

In a second aspect, as shown in FIG. 3, the invention provides a microfluidic system for size-based particle separation, comprising: (a) a first microfluidic device 310 according to the first aspect of the invention and (b) a second microfluidic 330 device according to the first aspect of the invention, where an outlet channel 320 (in this example, the central outlet channel 321) of the first microfluidic device 310 is in communication with the inlet channel 335 of the second microfluidic device 330. In one embodiment, the central outlet channel 321 of the first microfluidic device 310 and the inlet channel 335 of the second microfluidic device 330 comprise a single continuous channel, as shown in FIG. 3. In a further embodiment, the microchannel of the insulator constriction 336 of the second microfluidic device 330 is narrower than the microchannel of the insulator constriction 316 of the first microfluidic device 310 to allow further refined particle sorting.

In a third aspect, the invention provides a microfluidic system for size-based particle separation, comprising: (a) a main reservoir and (b) a plurality of microfluidic devices according to the first aspect of the invention, where the main reservoir is coupled to the inlet reservoir of each of the plurality of microfluidic devices. This arrangement allows a greater amount of the bulk solution containing particles to be sorted in a shorter amount of time. Furthermore, the sorting efficiency can be increased by additional sorting of the particles directed into the center outlet channel stream after a first round of sorting for increased recovery and output volume of the desired particle size. The particle yield will be dependent on the initial concentration of the bulk solution. There is no loss of particle yield due to sorting, since the entire solution is recovered in the outlet channels' reservoirs. Moreover, the inlet reservoir may be filled or replenished continuously during the sorting process.

In a fourth aspect, the invention provides a microfluidic system for size-based particle separation, comprising: a microfluidic device according to the first aspect of the invention in communication with a microfluidic nozzle or nozzle assembly. Example nozzles are described in U.S. Pat. No. 8,272,576, entitled Gas Dynamic Virtual Nozzle for Generation of Microscopic Droplet Streams, in U.S. patent application Ser. No. 13/680,255, filed Nov. 19, 2012, entitled Apparatus and Methods for a Gas Dynamic Virtual Nozzle, in U.S. Pat. No. 7,341,211, entitled Device for the Production of Capillary Jets and Micro- and Nanometric Particles or in U.S. Published Application No. 2010/0163116, published Jul. 1, 2010, entitled Microfluidic Nozzle Formation and Process Flow, the disclosures of which are herein incorporated by reference. The foregoing example nozzles are not intended to be limiting, as the microfluidic device may be used in conjunction with a wide variety of microfluidic nozzles capable of producing a jet, a stream, or fluid flow in general. In one embodiment, the microfluidic device and the nozzle may be arranged such that the nozzle is in fluid communication with any outlet reservoir of the microfluidic device such that the nozzle receives a portion of the sorted bulk solution in operation. In this case, the sorted solution may be directly used in a further downstream application without the need for reservoir extraction, which may improve recovery, reduce contamination and reduce sample damage.

In a fifth aspect of the invention, a method is provided that includes the step of providing a bulk solution containing a plurality of particles in an inlet reservoir, where the plurality of particles comprise particles having a first size and particles having a second size, where the particles having a first size are larger than the particles having a second size. The particles having a first size may range in size about 1 μm to about 100 μm, for example, while the particles having a second size may range in size from about 10 nm to about 1 μm, for example. In other embodiments the particles having a first size are on the order of about 1 to about 1000 times larger than the particles having a second size. In various other embodiments, particles having additional sizes may be sorted by modifying the size and number of the off-center outlet channels.

The method of the fifth aspect of the invention further includes the step of generating electroosmotic flow ("EOF") to transport the plurality of particles in the bulk solution. In one embodiment, EOF is generated through the application of an electric potential to the various reservoirs of the microfluidic device 10. For example, in one embodiment, a positive voltage is applied to the inlet reservoir 15 and a negative voltage is applied to one or more outlet channels 20 or vice versa. In various embodiments, the one or more outlet channels 20 may comprise a plurality of off-center outlet channels 22, a central outlet channel 21, or both. In a further embodiment, a voltage applied to the central outlet channel 21 may be greater than a voltage applied to each of the plurality of off-center outlet channels 22. In this embodiment, voltage applied to the central outlet channel 21 may be in the range from about 0 V to about ±1000 V, and the voltage applied to each of the plurality of off-center outlet channels 22 may be in the range from about 0 V to about ±1000 V. In addition the voltage applied to the inlet reservoir 15 may range from about 0 to about ±1000 V. In another embodiment, alternating current ("AC") potentials may be utilized to evoke the selectivity of DEP.

In addition, in various embodiments, pressure-driven flow of the bulk solution may be used along or in addition to EOF to move the bulk solution through the microfluidic device.

The method of the fifth aspect of the invention also includes the step of causing dielectrophoresis ("DEP") as the plurality of particles migrate from the inlet reservoir 15 into a microchannel 17 of an insulator constriction 16. In one embodiment, the step of causing DEP includes applying one of a positive or negative voltage to the inlet reservoir and applying an opposite-charged voltage from that applied to the inlet reservoir 15 to one or more outlet channels 20. In addition, applying one of a positive or negative voltage may be accomplished using alternating and/or direct current, and applying the opposite-charged voltage may be accomplished using alternating and/or direct current.

In addition, the method of the fifth aspect of the invention includes the step of sorting the particles having a first size and the particles having a second size. In one embodiment, the DEP is negative. In this embodiment, as shown, for example in FIG. 4C, the step of sorting the particles having a first size and the particles having a second size includes repelling the particles having a first size from walls of the microchannel 17 such that the particles having a first size are focused in the center of the microchannel 17 and directing the particles having a first size into a central outlet channel 21. The step of sorting the particles also includes repelling the particles having a second size from the walls of the microchannel 17 to a lesser degree than the particles having a first size such that the particles having a second size are focused near the walls of the microchannel 17 and directing the particles having a second size into a plurality of off-center outlet channels 22.

In another embodiment the DEP is positive. In this embodiment, the step of sorting the particles having a first size and the particles having a second size includes attracting the particles having a first size to walls of the microchannel 17 such that the particles having a first are focused near the walls of the microchannel 17 and directing the particles having a first size into the plurality of off-center outlet channels 22. The step of sorting the particles also includes attracting the particles having a second size to the walls of the microchannel 17 to a lesser degree than the particles having a first size such that the particles having a second size are focused in the center of the microchannel 17 and directing the particles having a second size into the central outlet channel 21.

The method according to the fifth aspect of the invention may be repeated using a solution containing only the particles directed into the central outlet channel. This will provide a particle with narrowed particle size distribution.

The method according to the fifth aspect of the invention may be carried out using the microfluidic device according to any of the first, second, third and fourth aspects of the invention. Note further that any of the foregoing embodiments of any aspect may be combined together to practice the claimed invention.

Example 1

Dielectrophoretic Sorting of Polystyrene Beads and Membrane Protein Nanocrystals The following example demonstrates the proof of principle of this novel microfluidic device with nanometer-sized beads and shows that numerical models accounting for the transport process at the constriction are in excellent agreement with experiments. Furthermore, the microfluidic device was applied to crystals of photosystem I ("PSI"), a large membrane protein complex consisting of 36 proteins and 381 cofactors. These crystals comprise one of the most challenging samples for any microfluidic sorting device as they are very fragile due to having a solvent content of 78% and only four salt bridges acting as crystal contact sites. Yet, excellent sorting of size-heterogeneous PSI crystal samples was demonstrated using size characterization methods such as dynamic light scattering ("DLS") and fluorescence microscopy, as well as second order non-linear imaging of chiral crystals ("SONICC"), as a characterization method for sample crystallinity.

Results and Discussion

Figure 4C:
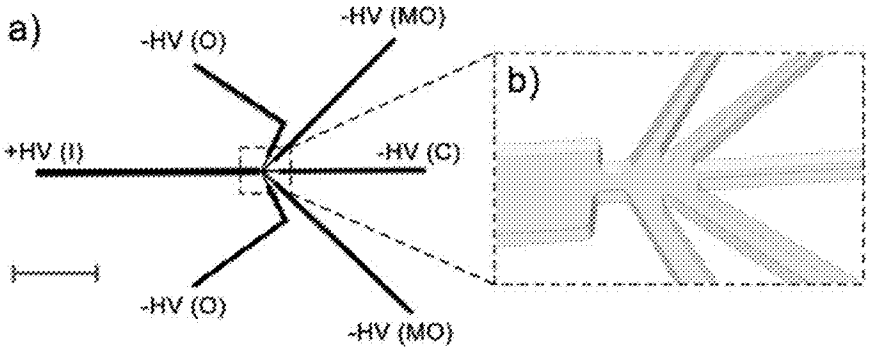
FIG. 4C is a detail top view of the microfluidic device's inlet reservoir, sorting region and plurality of outlet microchannels. Areas of high $\nabla E^2$ are shaded in representing where the largest DEP response is realized. As illustrated, negative DEP repels particles from these areas proportional to their DEP mobilities. Larger particles focus inward towards the center outlet channel of the device, as shown by the thicker, solid arrows. Conversely, smaller particles that experience less $F_{DEP}$ are deflected into the off-center outlet channels as illustrated with the thinner, dashed arrows.
Figure 4C:
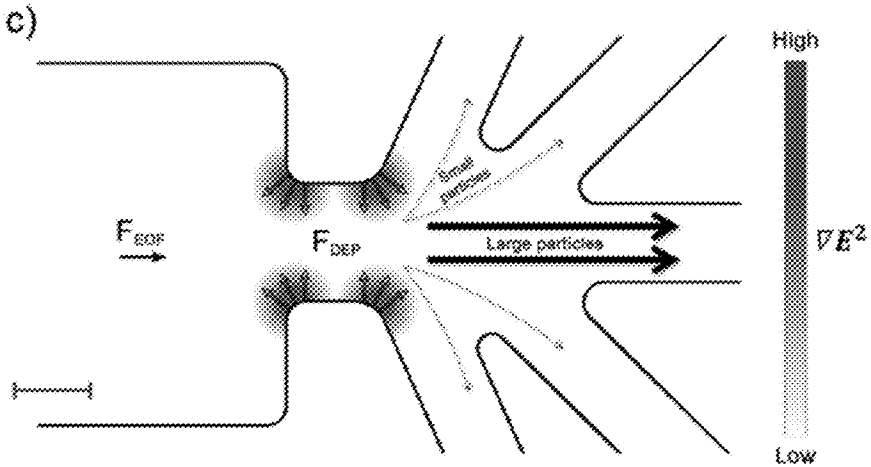

A schematic of the crystal sorter is shown in FIG. 4A providing the overall device layout and showing the sorting region in detail in FIG. 4B. The device is 5 mm in total length with a single inlet channel (I) of 100 μm width and 12 μm depth which leads to a series of five outlet channels (O: outer, MO: midouter, and C: center). A small overall channel length was selected so that high electric field gradients could be generated with low applied potentials in order to avoid Joule heating effects and sample destruction. The junction between the inlet and outlets is a constriction region (FIG. 4B) of 30 μm width where regions of higher gradients of the electric field squared ($\nabla E^2$) form. This geometry thus evokes DEP forces on nanometer- and micrometer-sized particles streaming through. The particles flow through the device from the inlet to outlets via electroosmosis and, upon entering the constriction region, experience a repulsive DEP force from the high gradient region inward caused by negative DEP (nDEP), indicated as $F_{DEP}$ in FIG. 4C. Larger particles with greater DEP mobilities ($\mu_{DEP}$) experience more repulsion in this area and are focused into the center outlet (C) as indicated by solid, thick arrows. Conversely, smaller particles with lower $\mu_{DEP}$ experience less repulsion and are able to deflect into the side outlets (O, MO) as indicated by the thinner, dashed arrows.

Numerical Simulations

Figure 5:
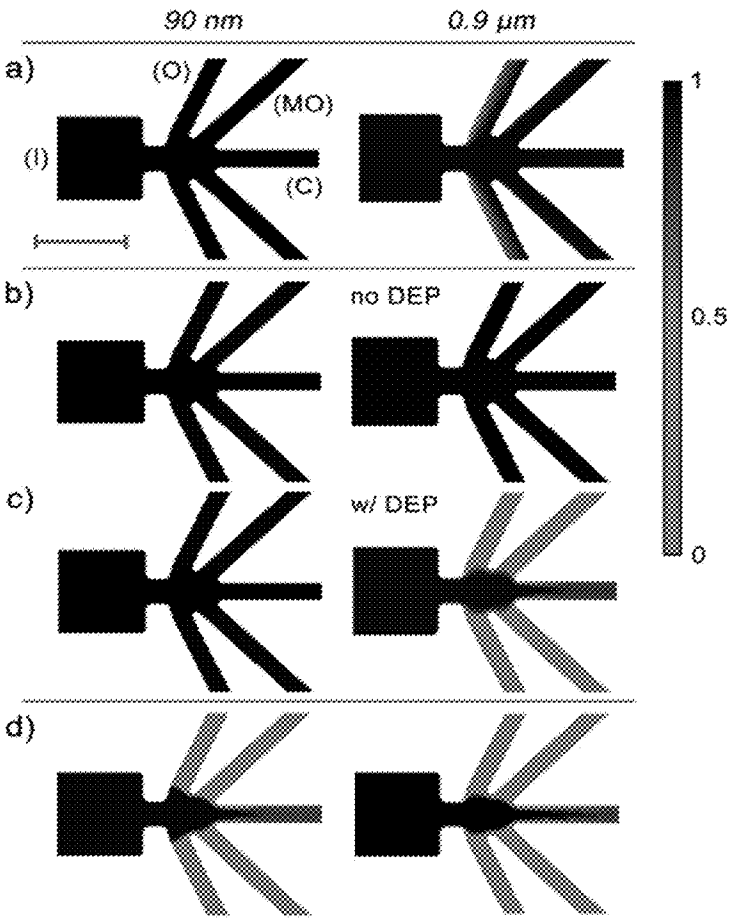
FIG. 5 is a series of partial top views of the microfluidic device's inlet reservoir, sorting region and plurality of outlet microchannels showing various concentration distributions as obtained from numerical simulations for 90 nm and 0.9 μm particles in the microfluidic device at various potential schemes (+10V applied to the inlet reservoir in FIGS. 5*a*) to *d*)). The legend represents the concentration normalized to the inlet reservoir concentration.

Numerical simulations with two representative bead sizes (90 nm and 0.9 μm) were performed to model the sorting efficiency and reveal the influence of DEP on the particle concentration profiles according to details described in the Experimental section below. In FIG. 5A), the concentration distribution for 90 nm and 0.9 μm beads is shown when −20V is applied to all outlet channels (O, MO, C). Both particle sizes completely deflect into all outlet channels and thus no sorting occurs. FIGS. 5B) and 5C) represent the concentration distributions for polystyrene bead sorting parameters (−60V applied to central outlet channel, −20V applied to off-center outlet channels), with and without DEP considered. In the non-DEP case (FIG. 5B), particles completely deflect into all outlet channels similar to the conditions of FIG. 5A). However, when DEP is added (FIG. 5C), a focusing effect on the 0.9 μm particles occurs as seen by >95% of the initial concentration in the central outlet channel and <5% of the initial concentration in the MO and O off-center outlet channels. Furthermore, the smaller, 90 nm nanoparticles deflect and are equally distributed into all outlet channels (>95% concentration). The 90 nm particles are effectively isolated in the MO and O off-center outlet channels, thus demonstrating a sorting effect.

These aforementioned simulations provide evidence that DEP plays a significant role in the sorting process. Moreover, FIG. 5D considers a higher negative potential (<−80V) focusing both the 90 nm and 0.9 μm particles into the central outlet channel (>95% concentration) with little deflection into the side outlets (<5% concentration). The importance of an optimal potential scheme balancing the flow at the constriction with the DEP forces is thus substantiated with this series of simulations. Altogether, numerical modeling demonstrated that this novel microfluidic sorter device provides the needed flexibility to adjust the potentials in each outlet channel to optimize the sorting efficiency.

Bead Sorting

Figure 6A:
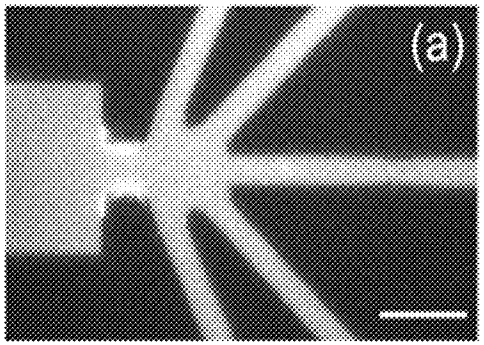
FIG. 6A is a fluorescence microscopy snapshot showing partial top view of the microfluidic device's inlet reservoir, sorting region and plurality of outlet channels illustrating 90 nm beads with non-preferential behavior with regard to the plurality of outlet channels such that the beads are distributed in all outlet channels with −60V applied to the center outlet channel (−20V to all other outlet channels).
Figure 6B:
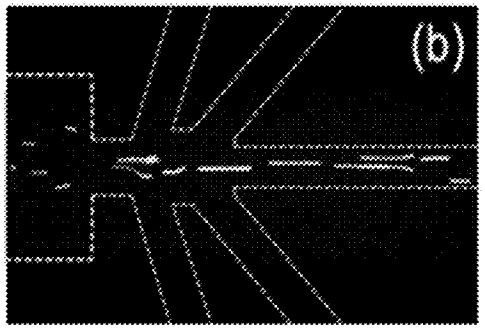
FIG. 6B is a fluorescence microscopy snapshot showing a partial top view of the microfluidic device's inlet reservoir, sorting region and plurality of outlet channels with 0.9 μm beads focused in the central outlet channel with the same potential scheme described with respect to FIG. 6A.

The microfluidic sorting device was subsequently tested experimentally with 90 nm and 0.9 μm fluorescently labeled polystyrene beads with known nDEP behavior. Beads were suspended in low conductivity buffer (15 μS/cm) to obtain ionic strengths similar to crystallization buffers used with PSI crystals (see below). Channels were dynamically coated with F108 blocking polymer to reduce severe adsorption of polystyrene beads to PDMS channel walls, to reduce electroosmotic flow (EOF), and to avoid clogging due to particle aggregation. Bead experiments were initially performed by applying low potentials (−20V to all outlet reservoirs with +10V to the inlet) in order to avoid possible damage to protein crystals in future experiments. At this potential scheme, both bead types flowed into all outlet channels without sorting, which is in agreement with the corresponding simulation for identical potentials (see FIG. 5A). To induce focusing, a larger negative potential (−80V and below) was applied to the center outlet and the outcome was again in agreement with simulation data (see FIG. 5D) as both bead sizes focused in the center outlet channel. Finally, the optimum sorting condition was found at approximately −60V in the center outlet while maintaining −20V in all other outlets. The 0.9 μm particles focused into the central outlet channel (FIG. 6B) whereas the 90 nm particles deflected into all outlet channels (FIG. 6A).

Figure 6C:
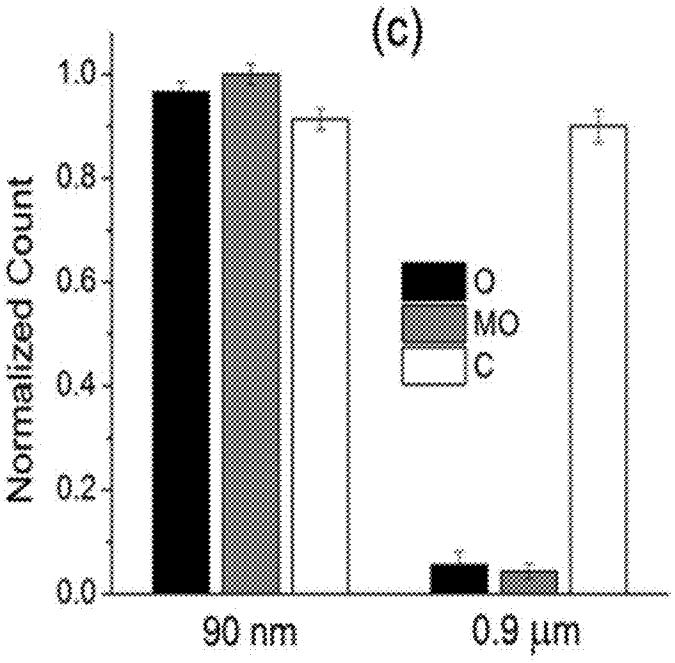
FIG. 6C is a table illustrating quantified particle distributions in each outlet channel for both 0.9 μm and 90 nm particle sizes as measured by fluorescence intensity for the 90 nm beads and particle counting for the 0.9 μm beads. A relatively equal distribution is shown for 90 nm beads whereas 90% of the 0.9 μm beads focus in the center outlet channel. Error bars represent the standard deviation.

Fluorescence intensities of the 90 nm beads in the outlet channels relative to the inlet reservoir were analyzed and 0.9 μm beads were counted since they are large enough to be imaged individually. An almost equal distribution of 90 nm beads was found in all outlet channels whereas 90% of the 0.9 μm beads focused into the center outlet (FIG. 6C). This result is thus in excellent agreement with simulations shown previously in FIG. 5C. This sorting phenomenon is attributed to an optimum DEP condition acting on the two bead sizes, focusing the larger particles in the center while allowing smaller particles to disperse into the side outlet channels (MO and O). Four trials were further analyzed to determine the sorting efficiency defined by the ratio of concentration in the deflected solution versus the initial concentration in percent. FIG. 6C indicates that a sorting efficiency of >90% is achieved for the 90 nm beads in the O and MO outlet channels. For the 0.9 μm beads, a sorting efficiency of 90% in the center (C) outlet was observed. Additionally, because of an equal distribution of smaller, 90 nm particles into all outlet channels, 80% recovery of these particles is obtained since four of the five outlet channels contained the smaller, 90 nm particles at approximately the same concentration. These results indicate high recovery of the 90 nm beads with negligible dilution which is ideal for nanocrystallography, where the smaller particle size range is targeted.

Photosystem I Experiments

Figures 7A, 7B, 7C, 7D:
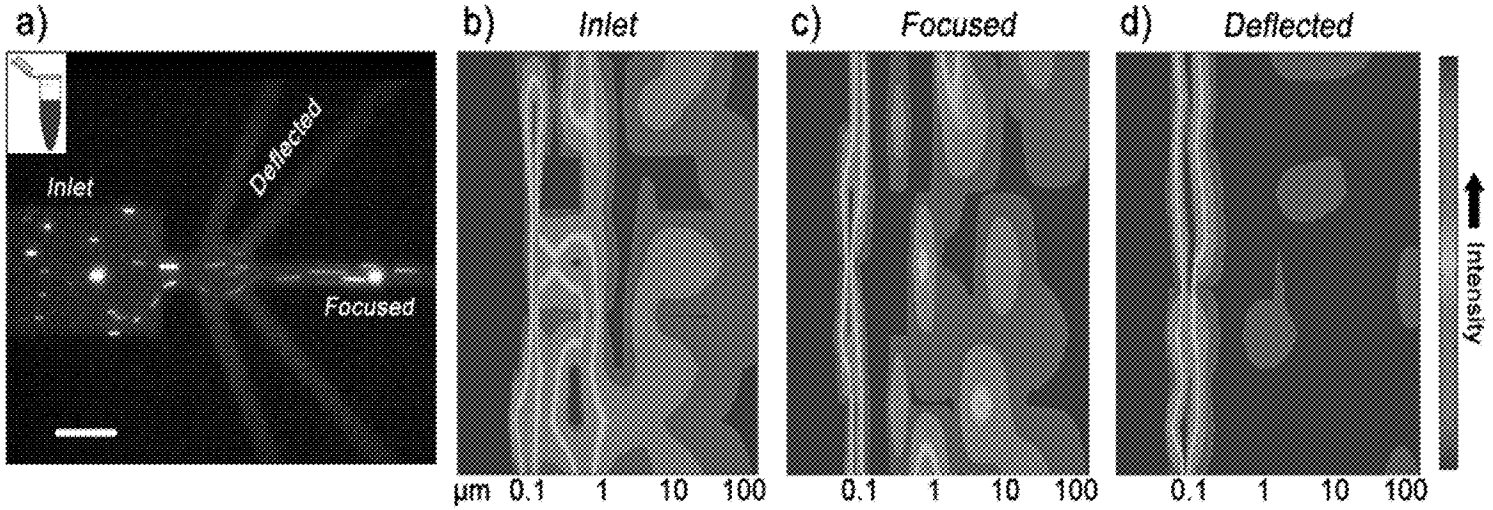
FIG. 7A is a fluorescence image showing a partial top view of the microfluidic device's inlet reservoir, sorting region and plurality of outlet channels with PSI crystal sorting. Large crystals are shown focused in the center of the device and smaller particles (as indicated by bulk fluorescence) are deflected into the off-center outlet channels.
FIG. 7B is a DLS heat map of a bulk crystal solution with particle size ranging from approximately 80 nm to 20 μm injected into the inlet reservoir shown in FIG. 7A.
FIG. 7C is a DLS heat map of the particles focused in the central outlet channel shown in FIG. 7A with particle size ranging from approximately 80 nm to 20 μm.
FIG. 7D is a DLS heat map of the solution deflected into outer and middle outlet channels showing a narrower size distribution than that of FIGS. 7B and C of fractionated nanocrystals around 100 nm in size.

PSI crystals were prepared and suspended in a low salt MES buffer containing the detergent β-DDM which forms protein-detergent micelles that mimic the natural lipophilic membrane environment to maintain protein stability and solubility. Surprisingly, crystal adsorption to non-coated PDMS channels was insignificant in preliminary experiments. Consequently, the native protein crystallization buffer was used to maintain the optimum environment for crystal stability during all sorting experiments and a channel coating agent was not employed. The procedure to sort crystals was similar to that of the beads, however, lower potentials were used because EOF velocity increases in native PDMS channels. Optimal sorting was achieved with −45V applied to the center outlet, −20V to the side outlets, and +10V to the inlet whereby larger crystals migrated towards the center channel and smaller crystals deflect into the MO and O side outlet channels. A fluorescence microscopy snapshot under these conditions is shown in FIG. 7A.

Unlike the simple two-sized bead model, the crystal bulk solution contained a large size distribution making it difficult to determine the crystal sizes being sorted into the side channels via fluorescence microcopy. We thus utilized DLS to characterize sorted PSI crystal fractions. FIGS. 7B-D show DLS measurements in the form of intensity heat maps for the inlet reservoir bulk solution, the combined deflected solutions, and the central outlet reservoir solution, respectively. As expected, the bulk solution had a wide size distribution with particle radii ranging from ~80 nm to ~20 μm. The central outlet reservoir shows a similar distribution since particles of all sizes flowed into the central outlet channel. More importantly, the deflected solutions contained nanocrystals with a size range of ~80-200 nm indicating excellent selectivity for the desired size range below 500 nm. A DLS signal from the PSI trimer which is ~10 nm in size is absent, indicating the crystals did not dissociate during sorting. The microfluidic sorting device thus proved suitable to sort PSI nanocrystals in a size range preferred for femtosecond nanocrystallography. This is a vast improvement over current, low yielding settling procedures to isolate nanocrystals from protein crystallization trials of PSI that are currently the only method available to safely harvest nanocrystals.

For complete compatibility with current nanocrystallography instrumentation, a sample volume >250 μl is required. Thus, higher throughput capabilities of our device were tested with multiple PSI sorting experiments (see Experimental section for details). To improve the flow rate through the device by a factor of three, a different potential scheme was utilized. Increasing the inlet and center outlet potentials to +60V and −60V, respectively, while decreasing the MO and O side outlet potentials to −5V facilitated sorting at higher flow rates (3 μl/h). To analyze whether this new higher throughput scheme could provide a high volume of fractionated nanocrystals, the deflected solutions were extracted from multiple experiments to attain a total volume of 300 μl of deflected solution.

Figure 8A:
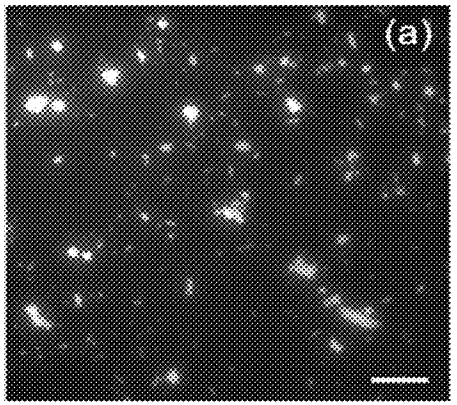
FIG. 8A is a fluorescence image showing a partial top view of the microfluidic device's inlet reservoir containing a highly polydispersed, larger volume particle sample in bulk solution. The scale bar is represents 50 μm.
Figure 8B:
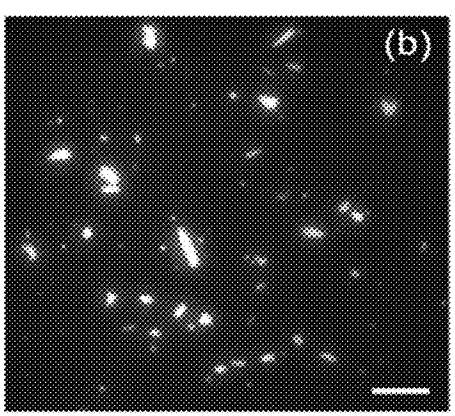
FIG. 8B is a fluorescence image showing a partial top view of the microfluidic device's central outlet reservoir containing solution from the center outlet channel after sorting a highly polydispersed, larger volume sample (with application of +60V to the inlet reservoir, −60V to the central outlet channel, −5V to the off-center outlet channels). The scale bar represents 50 μm.
Figure 8C:
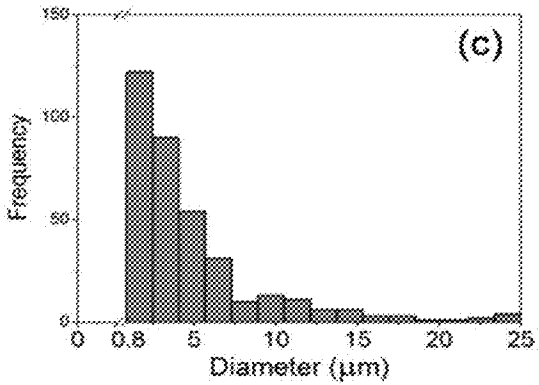
FIG. 8C is a histogram of the size distribution from an imaging threshold analysis in which a wide range of particle sizes from 800 nm to 20 μm are detected for the bulk solution in the inlet reservoir shown in FIG. 8A. The lower limit of detection for this method is 800 nm, therefore, nanocrystals below 800 nm could not be individually resolved.
Figure 8D:
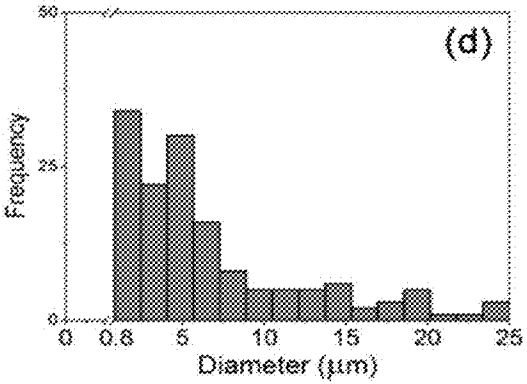
FIG. 8D is a histogram of the size distribution from an imaging threshold analysis in which a wide range of particle sizes from 800 nm to 20 μm are detected for the solution contained in the central outlet reservoir shown in FIG. 8B. The lower limit of detection for this method is 800 nm, therefore, nanocrystals below 800 nm could not be individually resolved.

Fluorescence microscopy images of the inlet and center outlet reservoirs can be seen in FIGS. 8A and B. To quantify the sorting efficiency, an imaging threshold analysis was performed to count particles present in the image frame as DLS is not suitable to quantify larger particle sizes and highly polydispersed samples. As expected, both solutions contained a large variation in crystal size. FIGS. 8C and D show histogram distributions of the crystal radii obtained from two image frames of the inlet and center outlet reservoirs. Particles with radii as large as 20 μm were detected in these solutions, which is in agreement with the DLS analysis of the low throughput experiments. Particles in the low micrometer range were present in the largest numbers, indicating they were focused into the center outlet (no deviation into the MO and O outlets).

Figure 9A:
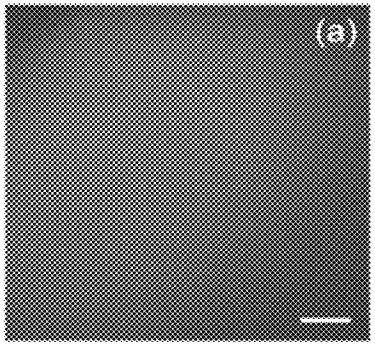
FIG. 9A is a fluorescence microscopy image of the solution in the outer outlet (O) reservoir containing the solution with deflected particles for the same experiment as shown in FIGS. 8A-D. As shown, very few particles can be individually resolved relative to the bulk solution of the inlet reservoir and central outlet reservoir shown in FIGS. 8A, B, indicating a high content of nanocrystals. The scale bar is 50 μm.
Figure 9B:
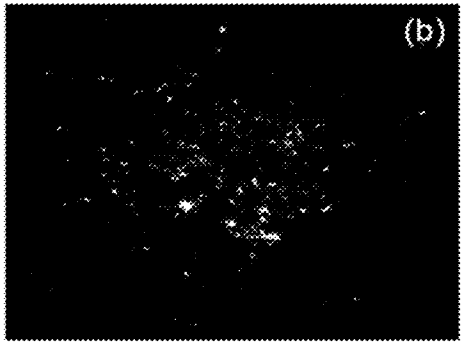
FIG. 9B is a SONICC image of the high volume sample in the outer outlet (O) reservoir indicating crystallinity of the sample after having passed through the microfluidic sorting device, as indicated by the second harmonic generation signal observed. The image indicates that the procedure is non-damaging to the sample crystals.

Images of the deflected solution in the outlet reservoirs highly contrasted that seen in the inlet and center outlet reservoirs. As illustrated in FIG. 9A, the majority of particles in the reservoir consisted of sizes below the optical resolution limit, indicating that nanocrystals were the major component of this solution. Furthermore, because of the higher concentration of crystals obtained from the high throughput experiment, second harmonic generation imaging analysis could be used to verify crystallinity. This analysis is important to verify the crystalline content of the sorted solution after the crystals were subjected to an electric field. Second harmonic generation via SONICC was utilized due to its powerful imaging capability to exclusively detect protein crystals while not producing signal for the trimer or the majority of salt crystals. FIG. 9B shows the resulting SONICC image of a droplet of sorted crystals which indicates non-centrosymmetric ordered crystals in the solution and thus verifies that crystallinity is maintained during the sorting process.

Figure 9C:
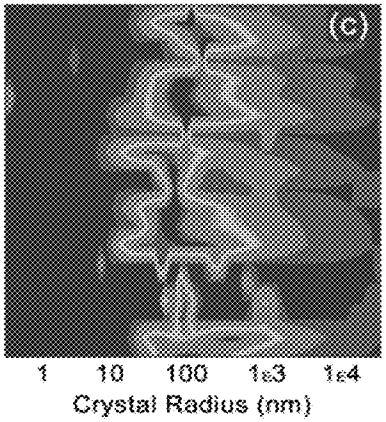
FIG. 9C is a DLS heat map of the deflected solution in the outer outlet (O) reservoir mainly containing nanocrystals (~60-300 nm) with a small contribution from microcrystals.
Figure 9D:
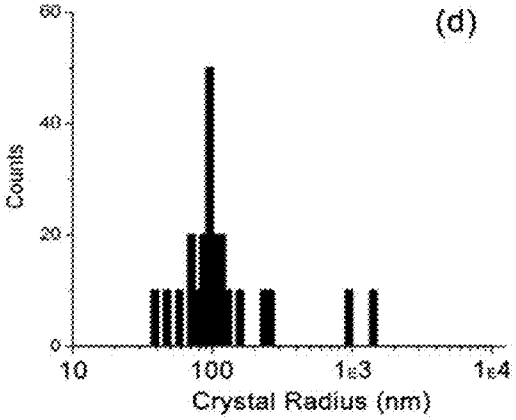
FIG. 9D is a histogram of the DLS measurement shown in FIG. 9C. The major peak represents crystals with radii of 100±30 nm, and an overall distribution shows a radii range of ~60-300 nm. A small contribution by microcrystals of ~1 μm in size is also shown.

To analyze crystal size in the large volume deflected solution, DLS was again used. FIG. 9C shows the DLS heatmap of the deflected solution and FIG. 9D shows a histogram of particle radius with respect to counts for the corresponding DLS run. The major peak corresponds to 100±30 nm radius and a slight increase in the overall radius distribution compared to the lower throughput sorting (FIG. 7) is observed with an overall radius distribution of ~60-300 nm with a small contribution from particles with radii of ~1 μm. The slight broadening of the main peak could be due to the duration of the experiment and the equilibrium between the crystal and surrounding solution where protein molecules are gained and lost over time causing larger crystals to form at the expense of smaller crystals. This "high throughput" experiment demonstrates the capability of this novel microfluidic sorter to provide large (~300 μl) volumes of fractionated nanocrystals without considerable dilution in the side channels. Moreover, the size distribution remains narrow and within the realm desired for femtosecond nanocrystallography.

Conclusions

A novel microfluidic sorter device for nanoparticles and large membrane protein complex crystals was demonstrated employing DEP. Numerical simulations of the sorting device first demonstrated its suitability for particle sorting of solutions containing sub-micrometer particles. Optimal conditions for polystyrene bead sorting revealed in numerical modeling were in excellent agreement with experimental results employing 90 nm and 0.9 μm beads. Applying similar conditions in low conductivity buffer to PSI crystals demonstrated that nanocrystals of ~100 nm in size can be isolated from a bulk solution containing a broad crystal size range. Even when multiple experiments were performed to provide a large volume of sorted sample, the process was reproducible and resulted in a large volume (~300 μL) of fractionated nanocrystals (~60-300 nm). This volume is in the range typically required for nanocrystallography experiments.

Furthermore, PSI remained crystalline as it passed through the sorting system as confirmed by second harmonic generation imaging. The flexibility of microfluidic device thus allows fine-tuning for optimal separation of delicate particles such as protein crystals even in the presently demonstrated case of fragile, PSI nanocrystals exhibiting high solvent content. The described method represents a microfabrication method, comprised of elastomer molding procedures and can thus be seamlessly used in crystallography laboratories. Applied potentials are below 100V and can be provided through readily available voltage sources. Besides reservoir recovery, the employed microfabrication method could also be directly coupled to a similarly fabricated nozzle to deliver crystals for femtosecond nanocrystallography. These optimal samples would aid in improving the efficiency of protein crystallography afforded by this technology, enabling structure elucidation and a new understanding of many proteins with unknown structures that catalyze key functions in biology.

Experimental Section

Numerical Simulations

To evoke DEP in the nanocrystal microfluidic sorting device, electric field gradients (∇E) are created at the constriction region as demonstrated in FIG. 4C. The dielectrophoretic force, $F_{DEP}$, acting at the constriction region is given by Equation 1:

$$F_{DEP}=2\pi r^3\epsilon_m Re[f_{CM}]\nabla E^2 \quad (1)$$

where r is the particle radius, $\epsilon_m$ is the medium permittivity, and $f_{CM}$ is the Clausius-Mossotti factor. The dependency of $F_{DEP}$ on r is exploited to sort particles by size within the microfluidic device. The sign of the DEP force is governed by $f_{CM}$, which under direct current (DC) conditions, is defined by the medium and particle conductivities, $\sigma_m$ and $\sigma_p$:

$$\mathrm{Re}[f_{CM}] = \frac{\sigma_p - \sigma_m}{\sigma_p + 2\sigma_m} \tag{2}$$

For the polystyrene beads employed in the modeling study as well as proof of principle experiments, $\sigma_p$ was considered negligible, therefore $f_{CM}$ is negative and nDEP prevails, in which particles experience more repulsion from regions with higher $\nabla E^2$.

Two particle sizes (90 nm and 0.9 μm) representative of the polystyrene bead experiments were modeled using Comso/Multiphysics 4.3. The DEP component was accounted for by the DEP velocity ($\mu_{DEP}$) and mobility ($\mu_{DEP}$):

$$u_{DEP} = -\mu_{DEP}\nabla E^2 = -\frac{r^2 f_{CM}\varepsilon_m}{3\eta}\nabla E^2 \tag{3}$$

Considering a $f_{CM}$ of −0.5, $\mu_{DEP}$ values for the 90 nm and 0.9 μm particles were calculated to be $-1.05\times10^{-21}$ $m^4/V^2\cdot s$ and −b $1.05\times10^{-19}$ $m^4/V^2\cdot s$, respectively. A two order of magnitude difference is apparent, reflecting the greater DEP response from the larger particles. In the case when no DEP contribution was considered, $\mu_{DEP}$ was set to zero. Additionally, the electrokinetic (EK) component was accounted for by the electrokinetic velocity ($\mu_{EK}$) and mobility ($\mu_{EK}$):

$$\mu_{EK}=\mu_{EK}E=[\mu_{EO}+\mu_{EP}]E \tag{4}$$

where $\mu_{EO}$ is the electroosmotic mobility, $\mu_{EP}$ is the electrophoretic mobility, and E is the electric field strength. Because polystyrene particles are large and exhibit negligible surface charge, the electrophoretic component is considered small compared to the electroosmotic mobility. Thus, $\mu_{EP}$ was neglected and a $\mu_{EO}$ of $1.5\times10^{-8}$ $m^2/V\cdot s$, as previously determined in similar devices and buffer conditions, substituted for $\mu_{EK}$.

Diffusion coefficients, D, for each particle size were calculated using the Stokes-Einstein equation, resulting in values of $4.9\times10^{-12}$ $m^2/s$ and $4.9\times10^{-13}$ $m^2/s$ for the 90 nm and 0.9 μm particles, respectively. Concentration profiles were obtained by computing the total flux, J, incorporating DEP, EK, and diffusion:

$$J=-D\nabla c+c[\mu_{EK}+\mu_{DEP}] \tag{5}$$

The system was solved at steady state, therefore:

$$\frac{\partial c}{\partial t} = \nabla\cdot J = 0 \tag{6}$$

The device geometry drawn in the software was an exact replicate (sans reservoirs) of the microfluidic channel system used experimentally. The solution conductivity used for all simulations was 15 μS/cm and applied potentials were +10V in the inlet reservoir (I), −20V in the off-center outlet channels (MO and O), and ranged from −20V to −80V in the central outlet reservoir (C). The Transport of Diluted Species package incorporated the $\mu_{DEP}$ and D for each particle size using the values presented above. The numerical model was solved for the electric field and creeping flow driven by EOF, which allowed for the transport of the particles to be calculated. With this modeling framework, concentration profiles were acquired for the constriction region and surrounding channel sections as shown in FIGS. 8A-D and discussed in the results and discussion section.

Materials and Chemicals

SU-8 photoresist was purchased from Microchem, USA. N-dodecyl-beta-maltoside (β-DDM) was from Glycon Biochemicals, Germany. 2-(N-morpholino)ethanesulfonic acid (MES), 4-(2-hydroxyethyl)piperazine-1-ethanesulfonic acid (HEPES), and poly(ethylene glycol)-block-poly(propylene glycol)-block-poly(ethylene glycol) (brand name Pluronic® F108) were from Sigma-Aldrich, USA. Fluorescently labeled polystyrene beads (1% w/v in aqueous suspension) with diameters of 90 nm ("pink", Ex: 570 nm, Em: 590 nm) and 0.9 μm ("yellow", Ex: 470 nm, Em: 490 nm) were obtained from Spherotech, USA. Polydimethylsiloxane (PDMS) (Sylgard® 184) was from Dow Corning, USA and glass microscopy slides were purchased from Fisher Scientific, USA.

Device Fabrication:

The microfluidic sorter was fabricated using standard photolithography and soft lithography. Briefly, AutoCAD software (Autodesk, USA) was used to design the sorting structure that was transferred to a chrome mask (Photosciences, USA). The mask was then used to create a silicon master wafer by patterning structures with the negative photoresist SU-8 via photolithography employing suitable exposure and developing steps. A PDMS mold was cast using the master wafer as a template in which the negative relief of the structure formed microchannels in the polymer. The complete device structure was removed from the mold, cut, and reservoirs were punched at the channel ends. The PDMS slab was then irreversibly bonded to a glass microscope slide using oxygen plasma treatment to create a sealed channel system.

Photosystem I Crystallization

PSI was purified and crystallized as previously described. Briefly, PSI trimers isolated from the cyanobacterium *Thermosynechococcus elongatus* were completely dissolved in 5 mM MES buffer containing 0.02% β-DDM and a high concentration of $MgSO_4$ (typically 100-150 mM) at pH 6.4. Nucleation is induced by depleting the salt concentration via the dropwise addition of $MgSO_4$-free buffer to achieve a final salt concentration of 6 mM $MgSO_4$. The concentration of protein in this low ionic strength solution is then slowly increased to a chlorophyll concentration of 10 mM, corresponding to a protein concentration of 35 μM PSI trimer, and the solution is allowed to incubate overnight for crystallization to occur. The crystals are then subjected to several washing steps with buffer containing 3 mM $MgSO_4$ and suspended in $MgSO_4$-free buffer containing 5 mM MES and 0.02% β-DDM (pH 6.4).

Sorting Experiments

For polystyrene bead experiments, 5 μl of 20 mM HEPES, 1 mM F108 buffer (pH 5.1) was added to all outlet reservoirs to fill channels via capillary action. 90 nm (size confirmed by DLS) and 0.9 μm polystyrene beads were diluted and mixed in the same buffer and sonicated to create homogenous dispersions. The 1% stock solution was used at a final dilution of 1:2000 (0.9 μm beads) and 1:1000 (90 nm beads).

For PSI experiments, crystals were suspended in their $MgSO_4$-free crystallization buffer (5 mM MES, 0.02% β-DDM detergent, pH 6.4). Platinum wire electrodes were placed in all reservoirs and electrodes from a multichannel DC voltage source (HVS448, Labsmith, USA) were connected. 5 μl of particle/crystal suspension was added to the inlet reservoir and Labsmith Sequence software (ver. 1.15, Labsmith, USA) was used to manually control each electrode voltage independently. Sorting experiments were generally run for 30 minutes during method development and testing. In addition to single run, small volume experiments, a scale up sorting experiment was performed with PSI to attain a total sorted sample volume of 300 μl. In this case, the small volume sorting experiment was performed 15 times at 3 hour durations per run to obtain a total of 300 μl of sorted nanocrystals from the MO and O outlet reservoirs (see FIGS. 4A-C).

Imaging of polystyrene beads was performed using a fluorescence microscope (IX71, Olympus, USA) with a dual band filter set (GFP/DsRed, Semrock, USA) to narrow the fluorescence excitation and emission to that of the bead fluorophores. The filter set contained a 468/34-553/24 nm exciter, 512/23-630/91 nm emitter, and 493-574 nm dichroic. An attached optical beamsplitter (Optosplit, Cairn Research, UK) containing 510/20 nm and 655/40 nm emission filters and a 580 nm dichroic mirror (Semrock, USA) was used to separate the fluorescence signal from each bead type into its own frame using a single b/w CCD camera (iXon, Andor, UK). Imaging of PSI crystals was performed using fluorescence microscopy with a microscope filter set containing a 470/40 nm excitation filter, 580 nm dichroic mirror (Semrock, USA), and a 690/70 nm emission filter (Chroma, USA). The optical beamsplitter was not employed for crystal sorting experiments. Micro-Manager (ver. 1.4, UCSF, USA) and ImageJ (ver. 1.46, NIH, USA) software were used for image acquisition, processing, and analysis.

Sample Analysis:

For polystyrene beads, 90 nm bead data was analyzed using fluorescence intensity in microchannel sections due to resolution limits of these smaller beads. Bead concentrations in each outlet channel were determined by comparing the fluorescence intensities of the outlet channels to that of the inlet channel. For 0.9 μm bead data, the Image J particle tracking plugin was used to count particles in the outlet channels for quantitative analysis.

For PSI small volume experiments, DLS (Spectro Size 302, Molecular Dimensions, USA) was used to analyze reservoir solutions and determine particle size distributions. After sorting crystals for approximately one hour, reservoir solutions were extracted with a transfer pipette and stored at 4° C. A 3 μl hanging droplet was setup in a 24 well crystallization plate and aligned to the DLS laser until a response signal was obtained. Each sample was subjected to 10 consecutive measurements lasting 30 seconds which were combined to intensity heat maps. For the large volume PSI experiments, DLS and second harmonic generation microscopy imaging via SONICC (SONICC instrument, Formulatrix, USA) were performed on the sorted solution to confirm nanocrystal isolation and post-sorting integrity of protein crystals, respectively. To quantify crystal sizes in the center reservoirs, an imaging threshold analysis was further performed to count particles present in the image frame. The image frame dimensions in pixels were scaled to micrometers and areas were obtained for each of the traced particles to calculate particle radius, assuming a spherical geometry. The lower limit of detection for this method was approximately 800 nm due to the inability to differentiate smaller particles.

Example 2

Sorting MCF-7 and MDA-MB-231 Cancer Cells

Figure 10B:
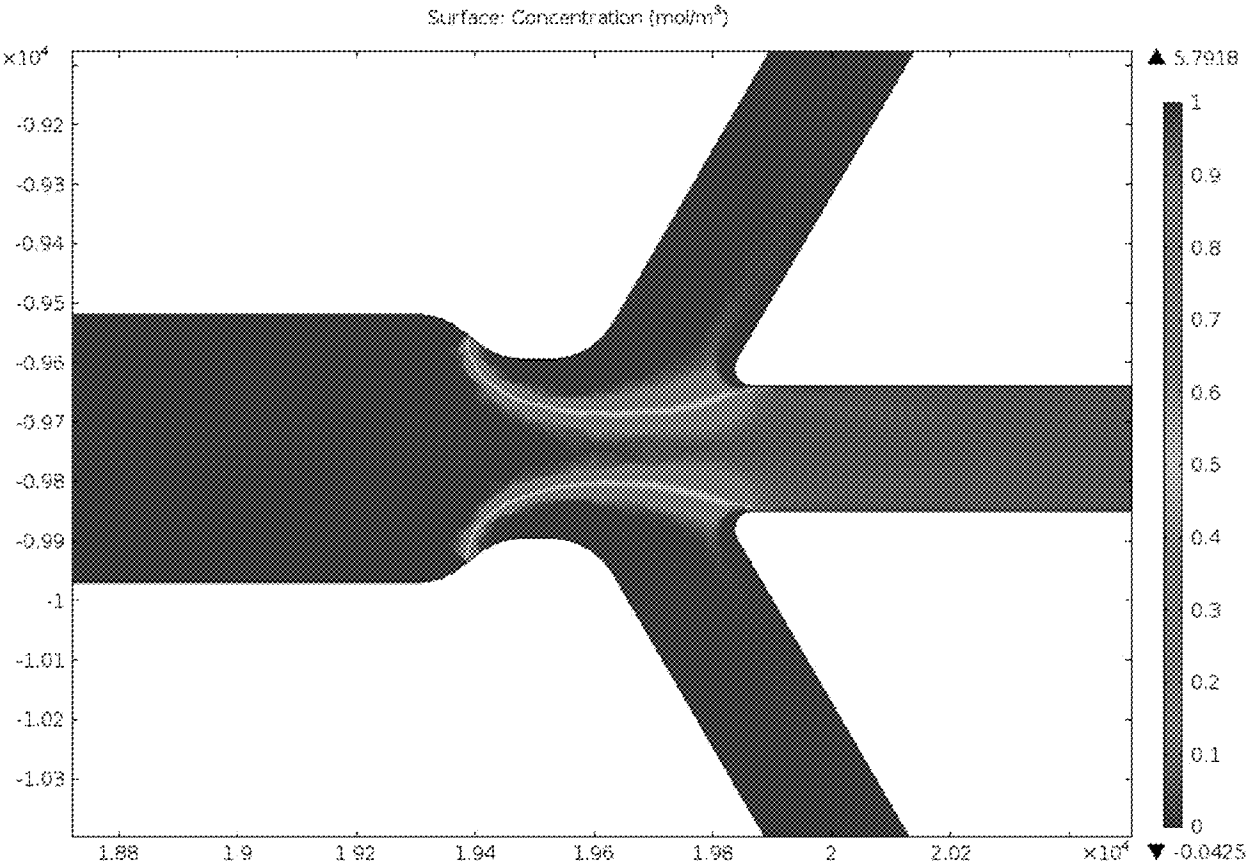
FIG. 10B shows concentration distributions as obtained from a numerical simulation showing MDA-MB-231 cancer cells centered in the central outlet channel with the application of negative DEP.

Numerical simulations of a fractionation design employing two off-center outlet channels and a central outlet channel are shown in FIGS. 10A and B. The two simulations show that two different kinds of cancer cells with small differences in size can be sorted with a microfluidic device. FIG. 10A shows that MCF-7 cells are deflected into off-center outlet reservoirs under positive DEP (>95% relative concentration in these channels), and FIG. 10B shows that MDA-MB-231 cells are focused into the central outlet channel (>95% relative concentration in this channel) under negative DEP. In this case, variability in the cell conductivities is exploited to induce a differential DEP response, as the cell sizes are nearly the same. This model uses cells with different metastatic characteristics, as it has been shown that more metastatic cells (which in this case is MDA-MB-231 versus the MCF-7) exhibit higher conductivities. Equation 2 above shows that for low cell conductivity with respect to the medium, negative DEP prevails as $f_{CM}$ becomes negative, thus $F_{DEP}$ becomes negative (Equation 1), and vice versa. Cell conductivites for these two cell types have been determined to differ by ~30 μS/cm in determining potentials necessary to achieve trapping of individual cancer cells, thus a medium conductivity in between the two can incite positive DEP on one cell type and negative DEP on the other, as previously described. Identical potentials are applied to the devices shown in FIGS. 10A and B to achieve the illustrated results. The legends in FIGS. 10A and B represent relative concentrations shown at the top of the legend and showing the deflection in the corresponding outlet channels. These simulations demonstrate the suitability of the device for sorting of the two cancer cell types with similar sizes. The simulations are adapted to dielectrophoretic conditions that were determined experimentally with the foregoing cancer cells. Other cells with varying metastatic characteristics can potentially show a similar sorting effect as well. Furthermore, size-based separation of cells is also possible using the mechanisms described in previous sections.

The invention claimed is:

1. A microfluidic device for size-based particle separation, the microfluidic device comprising:

an inlet reservoir, wherein the inlet reservoir is configured for communication with an inlet electrode;

an insulator constriction coupled to the inlet reservoir via a microchannel, wherein the insulator constriction comprises an insulating material; and a plurality of outlet channels each defining a first end and a second end, wherein the first end of each of the plurality of outlet channels is coupled to the insulator constriction, wherein the second end of each of the plurality of outlet channels is coupled to one of a plurality of outlet reservoirs, and wherein the plurality of outlet reservoirs are configured for communication with one or more outlet electrodes, wherein the plurality of outlet channels includes a central outlet channel, wherein the central outlet channel is substantially axially aligned with the inlet reservoir, wherein the plurality of outlet channels comprises a plurality of off-center outlet channels, and wherein a voltage applied to the central outlet channel from the one or more electrodes is greater than a voltage applied to each of the plurality of off-center outlet channels.

2. The microfluidic device of claim 1, wherein the plurality of off-center outlet channels are not axially aligned with the inlet reservoir.

3. The microfluidic device of claim 1, wherein a central axis for each of the plurality of off-center outlet channels is angled in a range from about 5 degrees to about 170 degrees from a central axis of the central outlet channel.

4. The microfluidic device of claim 2, wherein the plurality of off-center outlet channels comprise two middle outlet channels disposed on opposing sides of the insulator constriction and each arranged at an angle to the central outlet channel, wherein the two middle outlet channels are substantially linear along their length.

5. The microfluidic device of claim 4, wherein the plurality of off-center outlet channels comprise two outer outlet channels disposed on opposing sides of the insulator constriction, wherein the two middle outlet channels are arranged between the two outer outlet channels and the central outlet channel.

6. The microfluidic device of claim 5, wherein each of the two outer outlet channels has a first portion and a second portion, wherein the second portion of each of the two outer outlet channels are arranged at an angle to the first portion of each of the two outer outlet channels in a direction away from the central outlet channel in a range from 0 degrees to 180 degrees.

7. The microfluidic device of claim 5, wherein each of the two outer outlet channels is non-linear.

8. The microfluidic device of claim 1, wherein the inlet reservoir and the plurality of outlet channels all lie in the same plane.

9. The microfluidic device of claim 1, wherein the plurality of outlet channels have a three dimensional arrangement relative to one another.

10. The microfluidic device of claim 1, wherein the insulator constriction further defines a sorting region between the microchannel and the plurality of outlet channels.

11. The microfluidic device of claim 1, further comprising a second insulator constriction coupled either to the inlet reservoir or to one of the plurality of outlet channels.

12. The microfluidic device of claim 1, wherein a cross-section of the microchannel of the insulator constriction varies in width along the height of the cross-section.

13. The microfluidic device of claim 10, wherein a width of the sorting region is larger than a width of the microchannel, and wherein the width of the sorting region is smaller than a width of the inlet reservoir.

14. The microfluidic device of claim 1, wherein the one or more outlet electrodes comprise a single outlet electrode in communication with the central outlet channel.

15. The microfluidic device of claim 1, wherein the one or more outlet electrodes comprise five outlet electrodes.

16. A microfluidic system for size-based particle separation, the microfluidic system comprising:

a first microfluidic device of claim 1; and a second microfluidic device of claim 1, wherein an outlet channel of the first microfluidic device is in communication with an inlet reservoir of the second microfluidic device.

17. The microfluidic system of claim 16, wherein a microchannel of an insulator constriction of the second microfluidic device is narrower than a microchannel of an insulator constriction of the first microfluidic device.

18. A microfluidic system for size-based particle separation, the microfluidic system comprising:

a main reservoir;

a plurality of microfluidic devices configured according to claim 1, wherein the main reservoir is coupled to an inlet reservoir of each of the plurality of microfluidic devices.

19. A method for size-based particle separation using a microfluidic device, the method comprising:

providing a bulk solution containing a plurality of particles in an inlet reservoir, wherein the plurality of particles comprise particles having a first size and particles having a second size, wherein the particles having a first size are larger than the particles having a second size;

generating electroosmotic flow of the plurality of particles in the bulk solution;

causing dielectrophoresis as the plurality of particles migrate from the inlet reservoir into a microchannel of an insulator constriction; and sorting the particles having a first size and the particles having a second size, wherein causing dielectrophoresis comprises:

applying one of a positive or negative voltage to the inlet reservoir;

applying an opposite-charged voltage from that applied to the inlet reservoir to one or more outlet channels, wherein the insulator constriction couples the inlet reservoir to the one or more outlet channels; and wherein the one or more outlet channels comprises a central outlet channel and a plurality of off-center outlet channels, and wherein a voltage applied to the central outlet channel is greater than a voltage applied to each of the plurality of off-center outlet channels.

20. The method of claim 19, wherein the dielectrophoresis is negative, and wherein sorting the particles having a first size and the particles having a second size comprises:

repelling the particles having a first size from walls of the microchannel such that the particles having a first size are focused in the center of the microchannel;

repelling the particles having a second size from the walls of the microchannel to a lesser degree than the particles having a first size such that the particles having a second size are focused near the walls of the microchannel;

directing the particles having a first size into the central outlet channel; and directing the particles having a second size into the plurality of off-center outlet channels.

21. The method of claim 19, wherein the dielectrophoresis is positive, and wherein sorting the particles having a first size and the particles having a second size comprises:

attracting the particles having a first size to walls of the microchannel such that the particles having a first are focused near the walls of the microchannel;

attracting the particles having a second size to the walls of the microchannel to a lesser degree than the particles having a first size such that the particles having a second size are focused in the center of the microchannel;

directing the particles having a first size into the plurality of off-center outlet channels; and directing the particles having a second size into the central outlet channel.

22. The method of claim 19, wherein the one or more outlet channels comprises a plurality of off-center outlet channels.

23. The method of claim 19, wherein the voltage applied to the central outlet channel is in the range of 0 V to ±1000 V, and wherein the voltage applied to each of the plurality of off-center outlet channels is in the range of 0 V to ±1000 V.

24. The method of claim 19, further comprising adjusting a flow rate of the bulk crystal solution via pressure driven flow.

25. The method of claim 19, wherein applying one of a positive or negative voltage is accomplished using alternating and/or direct current, and wherein applying an opposite-charged voltage is accomplished using alternating and/or direct current.

26. The method of claim 19, wherein the method is repeated using a solution containing only the particles directed into the central outlet channel.

* * * * *